US009770140B2

(12) United States Patent
Cook

(10) Patent No.: US 9,770,140 B2
(45) **Date of Patent: *Sep. 26, 2017**

(54) SHOWER ENCLOSURE DESIGN AND ASSEMBLY METHODS USING PREFABRICATED SHOWER BENCHES

(71) Applicant: Joseph R. Cook, Parkland, FL (US)

(72) Inventor: Joseph R. Cook, Parkland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/733,538

(22) Filed: Jun. 8, 2015

(65) Prior Publication Data

US 2016/0015223 A1 Jan. 21, 2016

Related U.S. Application Data

(63) Continuation of application No. 13/674,716, filed on Nov. 12, 2012, now Pat. No. 9,049,969.

(51) Int. Cl.

| | |
|---|---|
| ***A47K 3/16*** | (2006.01) |
| ***A47K 3/28*** | (2006.01) |
| ***A47K 3/40*** | (2006.01) |
| ***E03F 5/04*** | (2006.01) |

(52) U.S. Cl.

CPC ..... *A47K 3/283* (2013.01); *A47K 3/282* (2013.01); *A47K 3/40* (2013.01); *E03F 5/0408* (2013.01)

(58) Field of Classification Search

CPC ..... A47K 3/40; A47K 3/284; A47K 4/579; A47K 3/283; A47K 3/282; E03F 5/0408

USPC ..... 52/35, 36.4, 36.5; 4/578, 579, 663

See application file for complete search history.

(56) References Cited

U.S. PATENT DOCUMENTS

| | | | | | |
|---|---|---|---|---|---|
| 2,197,874 | A * | 4/1940 | Myers | A47K 3/281 | 4/613 |
| 2,589,592 | A * | 3/1952 | Ocana | A47K 4/00 | 4/444 |
| 2,907,048 | A * | 10/1959 | Gould | E03C 1/01 | 4/597 |
| 3,718,365 | A * | 2/1973 | Gibson | B63B 29/04 | 114/363 |
| 3,992,825 | A * | 11/1976 | May | E04F 13/0889 | 52/146 |
| 4,557,004 | A * | 12/1985 | Piana | A47K 3/40 | 4/596 |
| 4,941,218 | A * | 7/1990 | McCartney | A47K 3/122 | 4/579 |
| 4,987,619 | A * | 1/1991 | Smith | A47K 3/284 | 4/595 |
| 5,224,224 | A * | 7/1993 | Hintz | A47K 3/022 | 4/541.1 |
| 5,742,956 | A * | 4/1998 | Tarver | A47K 4/00 | 4/644 |
| 5,845,347 | A * | 12/1998 | Young | A47K 3/40 | 4/613 |

(Continued)

*Primary Examiner* — Basil Katcheves

(74) *Attorney, Agent, or Firm* — Kevin P. Crosby; GrayRobinson, P.A.

(57) ABSTRACT

Methods and apparatus for creating a shower or bath enclosure, in which, given a predetermined area in which to create the shower or bath, a given prefabricated water proof bath or shower floor module is too small to occupy the entire available enclosure space. The apparatus includes the use of one or more additional enclosure components, such as one or more shower benches, to occupy a space between an edge or edges of the floor module and the exterior boundary(ies) of the enclosure space.

22 Claims, 35 Drawing Sheets

(56) References Cited

U.S. PATENT DOCUMENTS

| | | | | |
|---|---|---|---|---|
| 5,913,777 | A * | 6/1999 | Gerber | A47K 3/40 4/596 |
| 6,735,793 | B2 * | 5/2004 | Peterson | A47K 3/40 4/596 |
| 7,849,531 | B2 * | 12/2010 | Rooke | A47K 3/282 4/524 |
| 8,141,182 | B2 * | 3/2012 | Cook | A47K 3/40 4/613 |
| 9,049,969 | B2 * | 6/2015 | Cook | A47K 3/40 |

* cited by examiner

SHOWER ENCLOSURE DESIGN AND ASSEMBLY METHODS USING PREFABRICATED SHOWER BENCHES

CROSS-REFERENCE TO RELATED APPLICATIONS

The present application is a continuation of and claims priority to U.S. patent application Ser. No. 13/674,716, filed on Nov. 12, 2012, entitled "Shower Enclosure Design and Assembly Methods Using Prefabricated Shower Benches," which itself is a continuation of prior co-pending U.S. patent application Ser. No. 12/706,792, filed Feb. 17, 2010, entitled "Shower Enclosure Design and Assembly Methods Using Prefabricated Shower Benches," now U.S. Pat. No. 8,307,582, which is a continuation in part of prior co-pending U.S. patent application Ser. No. 11/724,913 filed on Mar. 17, 2007, entitled "Methods of Manufacturing and Installation of Prefabricated Shower Bench and Associated Shower Bench," now U.S. Pat. No. 8,141,182, which was commonly filed with the following U.S. Patent Applications: Ser. No. 11/724,873 entitled "Ribbed Prefabricated Polyurethane Shower Module," now abandoned, U.S. patent application Ser. No. 11/724,914 entitled "Method for Manufacturing a Prefabricated Modular Shower Curb and Associated Modular Shower Curb," now U.S. Pat. No. 8,141,183, U.S. patent application Ser. No. 11/725,113 entitled "Prefabricated Shower Pan Having Varying Sidewall Heights and Method of Attaching a Modular Curb Thereto," now U.S. Pat. No. 8,209,795, U.S. patent application Ser. No. 11/724,912 entitled "Improved Drain Wall for a Prefabricated Shower Module," now U.S. Pat. No. 8,181,286, and U.S. patent application Ser. No. 11/725,112 entitled "Improved Method for Manufacturing a Prefabricated Shower Module," now U.S. Pat. No. 8,375,480. The present application is also a continuation in part of the prior co-pending U.S. patent application Ser. No. 12/435,959, filed May 5, 2009, entitled "Waterproof Juncture," now U.S. Pat. No. 8,789,316, and U.S. patent application Ser. No. 12/463,803, filed May 11, 2009, entitled "Improved Method of Manufacture and Installation of Prefabricated Shower Benches and Associated Shower Benches," now U.S. Pat. No. 8,112,831. The content of these applications is fully incorporated by reference herein for all purposes.

The disclosures of each of the above-listed applications are expressly incorporated herein by reference as though fully set forth herein.

BACKGROUND OF THE INVENTION

Field of the Invention

The present invention relates generally to the design and manufacture of shower enclosures, and more particularly relates to the use of prefabricated shower benches in a shower enclosure to permit the shower enclosure designer and installer to precisely fit the components of the enclosure into the allotted space.

Description of the Prior Art

Most tile-covered shower enclosures are created using complicated construction methods. For example, using conventional techniques, a skilled installer frames out the area to be enclosed using two-by-four wooden or aluminum studs to create a frame and curb. Felt or tar paper is then laid over a subfloor area enclosed within the newly formed frame. A flexible, leak-proof liner is installed on top of the felt or tar paper and attached to the frame. Next, the installer attaches dry wall boards to the framing studs, creating shower sidewalls. A hole is cut in the liner to allow for a drain, and a layer of mortar is applied to the shower sidewalls and curb and allowed to cure. Additional mortar is applied on top of the leak-proof liner and hand-shaped to form a shower floor which slopes toward the drain such that water from the shower flows toward the drain. After the mortar has cured, shower tile is applied to the sidewalls and floor to create the finished enclosure.

The process of creating the enclosed shower is time-consuming and requires a certain degree of skill in order to maintain the proper pitch and uniformity in shaping the floor. Irregularities in the pitch of the floor can cause water from the shower not to drain properly or make tiling the shower enclosure difficult. The liners are also susceptible to punctures or leaks and may be difficult for the installer to properly form square corners at the intersection of the shower sidewalls and floor. Additionally, the mortar layer used to create the floor is necessarily thick in order to form a sloped surface, therefore the time required for the floor to cure before applying tile may be quite long (e.g., greater than 24 hours).

In recent years, the process of shower installation has been vastly improved by the introduction of prefabricated shower base modules used for forming the floor. Use of the prefabricated modules significantly decreases the amount of time and skill required to construct a tile-covered shower enclosure, as well as providing more of a consistent and reliable flooring surface upon which to tile. These modules are pre-constructed molded units having a sloping floor, an integrated drain, curb, sidewalls, and a horizontal surface on the top of each sidewall for mounting drywall such that the drywall is substantially flush to the module sidewalls. Installation of the module involves securing a section of drain pipe to the drain, applying adhesive and sealing material to the subfloor where the module will rest, and seating the module on the subfloor. Tile can then be applied directly to the shower walls and module without the need for first applying mortar.

However, these prefabricated shower modules contain weaknesses in the design which add cost to the final product. For instance, certain modules are manufactured using plastics-forming processes that inject molten polymeric resins into molds. After filling the mold with the resin, the module must cool (e.g., solidify) before being removed. If the module is removed before it is completely solid, bowing may occur as the module hardens. However, the mold or "tool" for creating each unit can be quite expensive, thus a manufacturer generally limits the number of tools for producing each module. Therefore, the number of modules manufactured in a given amount of time depends on the amount of time required for one module to sufficiently cool enough to be removed from the mold.

Further, each size module requires a specific mold, thus the manufacturer is forced to limit the selection of available modules to a few standard sizes. Because the curb may be integrated into the shower module, both the positioning of the curb, as well as the overall dimensions of the module are set by a single tool. The design options for a customer (e.g., an architect, a designer, a contractor, an installer, or homeowner) desiring to implement a prefabricated shower module are therefore limited to a few set arrangements.

Additionally, features such as shower benches or ledges presently must still be constructed by hand, or added in a piece-meal fashion, thereby compromising the leak-proof integrity of the prefabricated shower module.

Also, it is well known that the designing of a floor plan within a given fixed total square footage area is a challenging task. The challenge to the designer is to maximize the utility of the design, the feasibility of which is usually diminished due to the fact that certain standard features in any given design have fixed dimensions, i.e. dimensions around which the designer must create the overall floor plan.

One such feature is the prefabricated shower base module used in most shower construction today. Manufacturers of these products offer them in a variety of fixed dimensions. It is not desirable to manufacture shower based modules to be variable in dimension, as to do so would increase the risk of leakage at seams and joints within the module itself, defeating the purpose of using such a module in the first place.

In designing a shower enclosure space, it often occurs that the space available is somewhat larger in one or more dimension that the dimensions of the prefabricated shower base modules available on the market. When this happens, the sizes of the available shower base modules are "between sizes" relative to the available space for the enclosure. Obviously, it is always desirable to make the shower enclosure volume as large as possible, especially where the available "extra" space would otherwise be unused volume hidden between adjacent walls.

Therefore, a need exists for, among other things, methods for manufacturing and installing prefabricated shower benches in a system including prefabricated shower modules to produce a tiled shower enclosure, and the resulting benches, to overcome the shortcomings of the prior art.

DETAILED DESCRIPTION OF EXEMPLARY EMBODIMENT(S)

Figure 1:
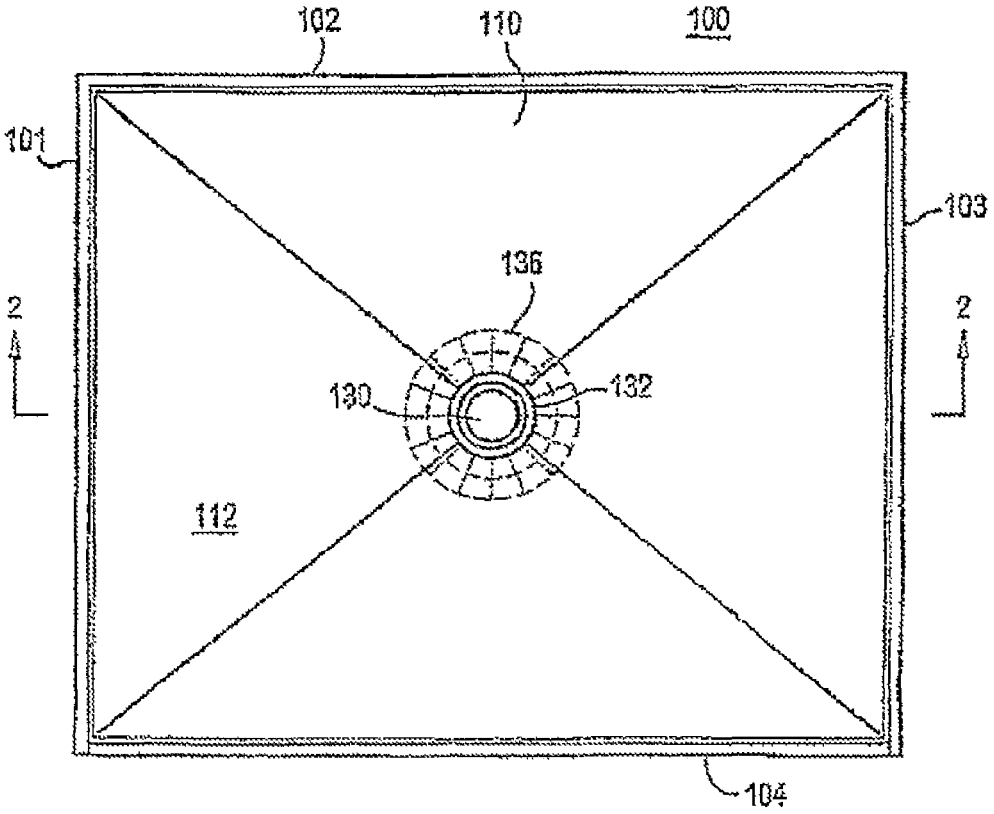
FIG. 1 is a top plan view of a prefabricated shower module in accordance with one embodiment of the present invention.
Figure 2:
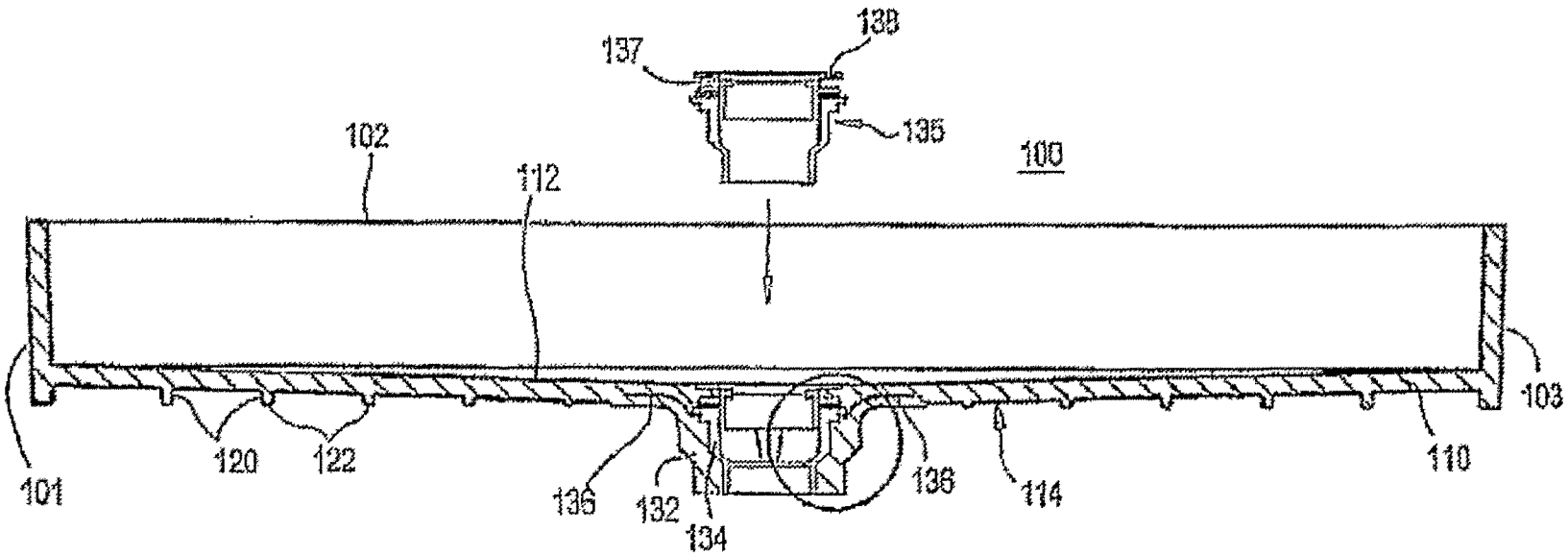
FIG. 2 is a side cross-sectional elevational view of the prefabricated shower module of FIG. 1 along the line 2-2.
Figure 2A:
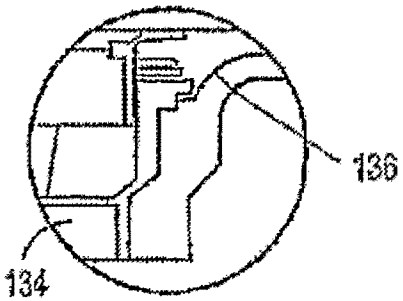
FIG. 2A is a close up of the area of detail shown in FIG. 2.
Figure 3:
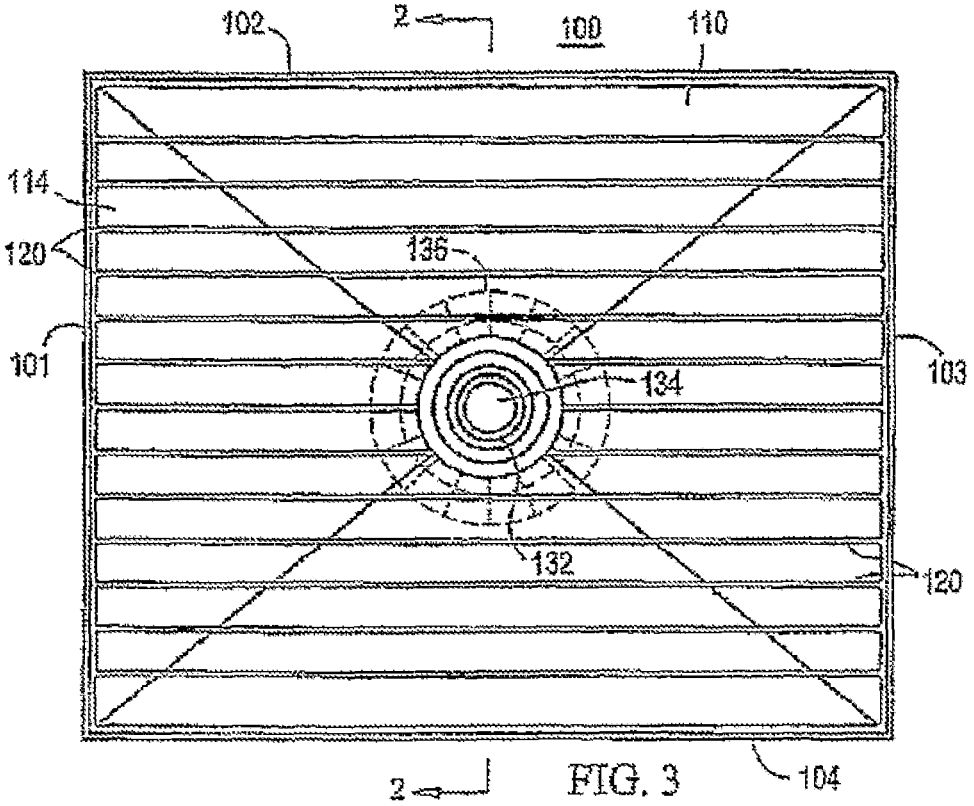
FIG. 3 is a bottom plan view of the prefabricated shower module of FIG. 1, illustrating a horizontal support rib arrangement.

Before describing in detail exemplary embodiments that are in accordance with the present invention, it should be observed that the embodiments reside primarily in combinations of apparatus components and processing steps related to implementing a method for improving manufacturability of a pre-molded leak-proof shower module having surfaces for receiving shower tile or stone thereon and the associated shower module. Accordingly, the apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element. The term "tile" also encompasses "stone" and/or "marble." The term "tiled" means any surface having tile, stone, and/or marble applied thereon. The term "sidewall," in relation to a shower module, means any vertical surface rising above the floor of the shower module along one or more peripheral edges and may be any height or any width, including, without limitation, an integrated curb. The term "shower enclosure space" refers to the volume defined by the framed-out walls, the area where the shower door or access area will reside, the bathroom sub-floor, and the ceiling.

Generally, the present invention encompasses a prefabricated modular system for constructing a tiled shower enclosure; an improved prefabricated shower module, modular curb, and shower seat for use within the system, and methods for manufacturing and installing the above components.

In describing the invention, reference will be made to a prefabricated leak-proof shower module suitable for use in constructing a tiled shower, which includes a plurality of sidewalls, and a floor that is bounded along at least one peripheral edge by at least one sidewall that extends vertically from the peripheral edge. The floor has an upper surface sloping downward from each peripheral edge toward a drain aperture and a lower surface with a plurality of support ribs, where each support rib extends downward from the lower surface to terminate in a common horizontal plane. Additionally, the upper surface may contain a plurality of pitching ribs which provide a uniform pitch from each peripheral edge to the drain aperture. Each support rib runs and each pitching rib runs either parallel to, perpendicular to, or at an acute angle to, at least one peripheral edge of the floor. The shower module may be created using polyurethane reaction injection molding processing. Alternative embodiments may include a horizontal bottom plane and/or an integrated molded curb.

A slightly modified version of a prefabricated modular curb suitable for use in constructing a tiled shower enclosure includes a mounting wall with an outer surface for engaging a sidewall of a shower module, an exterior wall, and a top wall that extends from an upper edge of the exterior wall to the upper edge of the mounting wall in a plane either substantially perpendicular to the mounting wall and to the exterior wall or pitching downward from the exterior wall to the mounting wall. The curb further includes at least one reinforcing curb rib that is attached to at least one of the top curb wall, the inner surface of the mounting wall, the inner surface of the exterior wall, and the bottom wall if any, and which rib runs either parallel to, perpendicular to, or at an acute angle to the mounting wall or the exterior wall.

A still further embodiment of a prefabricated shower bench for installation in a tiled shower includes a seating member having a plurality of peripheral edges, and at least three sidewalls, wherein each sidewall is connected to a corresponding peripheral edge of the seating member along an upper edge. One of the sidewalls includes a setback area along its entire lower edge that has a height greater than the height of one of the sidewalls of a prefabricated shower module. The lower edge of each sidewall terminates in a common plane.

Reference will also be made to a prefabricated shower bench for installation in a tiled shower, which includes a seating member having a plurality of peripheral edges, at least one sidewall depending downwardly from one or more of the peripheral edges. The seating member, and preferably also the depending sidewall, are associated with a support structure which can be manufactured as part of the shower bench, manufactured separately from the shower bench but associated with and/or attached to the shower bench during manufacturing, or installed in situ (i.e. in the field).

The forgoing apparatus are but a few of the many configurations of components that can be employed in the design and construction of the shower enclosures of this invention, and the scope of the invention is not intended to be limited to any particular component.

Prefabricated Shower Module.

The present invention can be more readily understood with reference to FIGS. 1-32, in which like reference numerals designate like items. FIGS. 1-4 depict an exemplary prefabricated leak-proof shower module 100 suitable for use in constructing a tiled shower in accordance with one embodiment of the present invention. As depicted in FIGS. 1-4, the exemplary shower module 100 includes a floor 110, and vertical sidewalls 101, 102, 103, 104 (4 shown). The upper surface 112 of the floor 110 and the vertical sidewalls 101, 102, 103, 104 are suitable for retaining tile, stone, or marble installed thereon. Each sidewall 101, 102, 103, 104 extends vertically from a peripheral edge of the floor 110. The floor 110 has an upper surface 112 that slopes downward from each peripheral edge toward a drain aperture 130, and a lower surface 114 that connects to a plurality of support ribs 120. The upper surface 112 slopes downward from each peripheral edge to the drain aperture 130 at a pitch of ⅛"/foot or greater.

Each support rib 120 extends downward from the lower surface 114 such that the bottom edge 122 of each support rib 120 terminates in a common horizontal plane. Additionally, each support rib 120 runs either parallel to, perpendicular to, or at an acute angle to, at least one peripheral edge of the floor 110. When the shower module 100 is installed to construct a shower enclosure, the shower module 100 is positioned on a subfloor of the shower enclosure in such a manner that the plurality of support ribs 120 provide support for the shower module 110 by resting on the subfloor, and a drain wall 132 surrounding the drain aperture 130 is positioned inside or above an opening in the subfloor that contains a plumbing connection.

Figure 4:
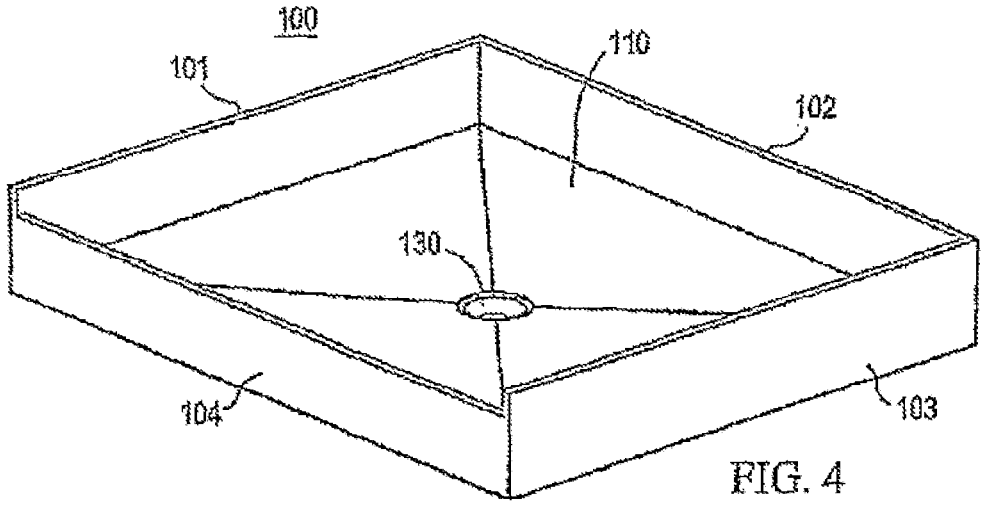
FIG. 4 is a front/top perspective view of the shower module of FIG. 1.
Figure 4A:
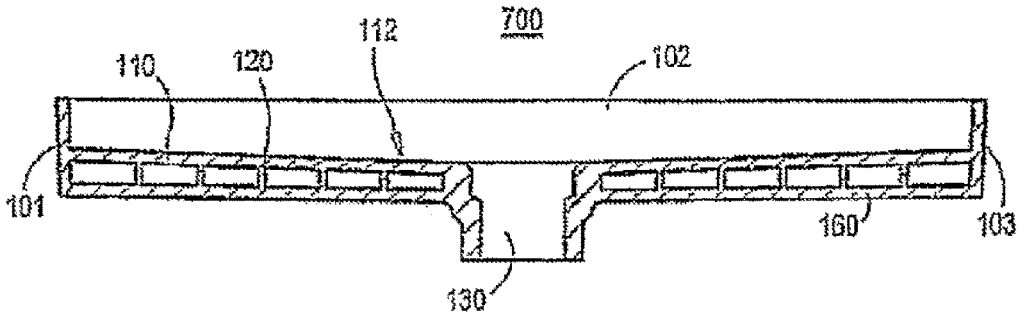
FIG. 4A is a front/top perspective view of a shower module in accordance with an alternative embodiment of the present invention.

In an alternative embodiment, as shown in FIG. 4A, the shower module 700 includes a bottom panel 160 that extends from each sidewall 101, 102, 103, 104 and/or each peripheral edge to the drain wall 132 in a horizontal plane. Thus, the bottom panel 160 rests on the subfloor of the shower enclosure when the shower module 100 has been installed. Additionally, the bottom edge 122 of each support rib 120 is connected to the bottom panel 160.

Figure 4B:
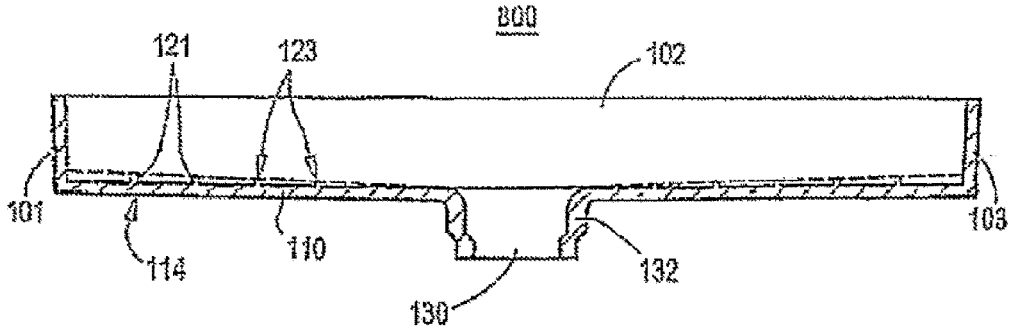
FIG. 4B is a front/top perspective view of a shower module in accordance with another alternative embodiment of the present invention.
Figure 5:
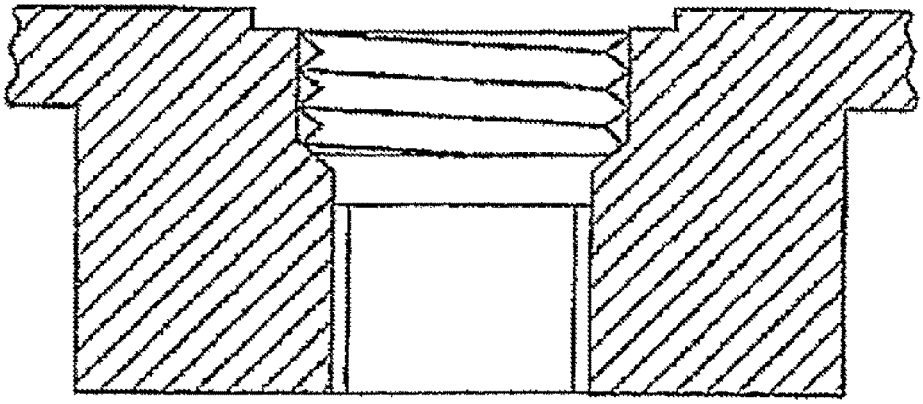
FIG. 5 PRIOR ART
FIG. 5 is a cross-sectional view of a prior art shower module drain assembly.
Figure 6:
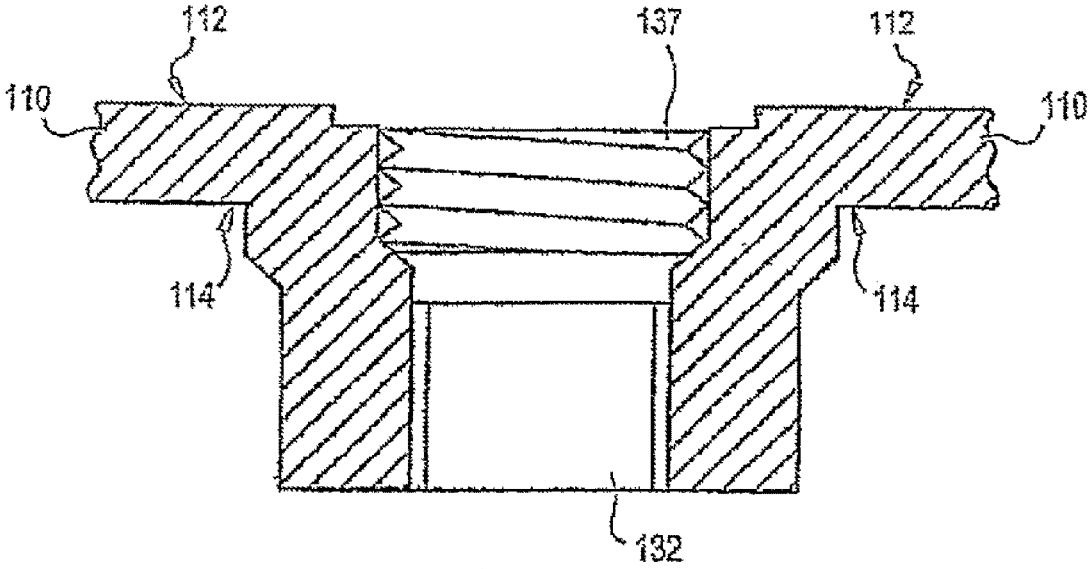
FIG. 6 is a cross-sectional view of an exemplary drain assembly, in accordance with an embodiment of the present invention.
Figure 7:
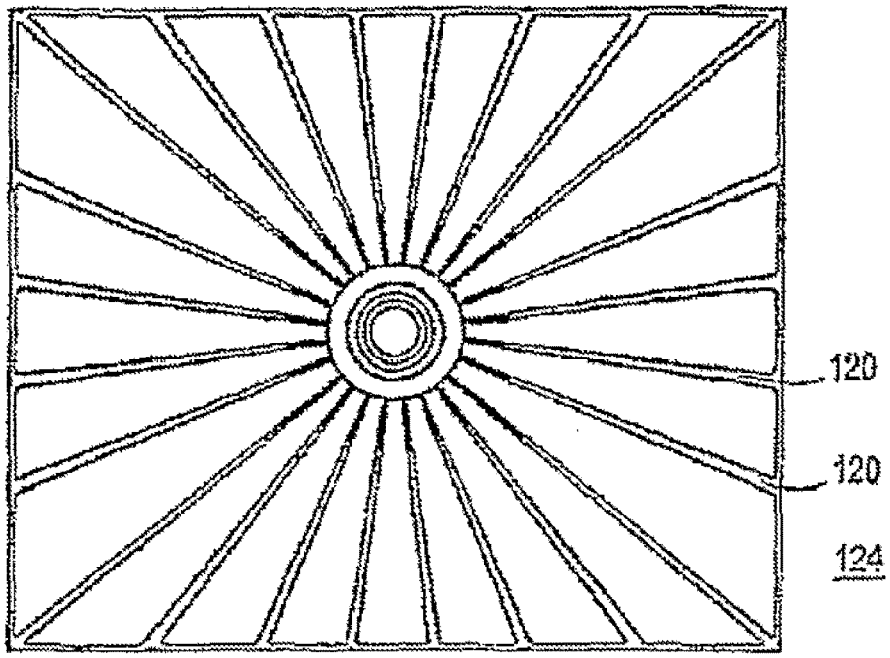
FIG. 7 is a bottom plan view of a prefabricated shower module, illustrating an exemplary sunburst support rib arrangement, in accordance with an alternative embodiment of the present invention.
Figure 8:
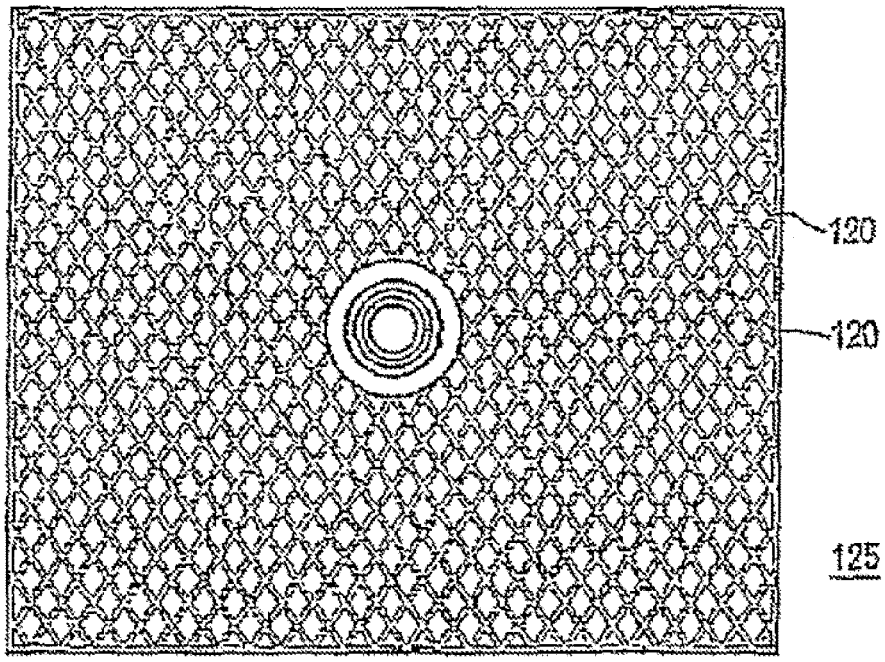
FIG. 8 is a bottom plan view of a prefabricated shower module, illustrating an exemplary diamond support rib arrangement, in accordance with an alternative embodiment of the present invention.
Figure 9:
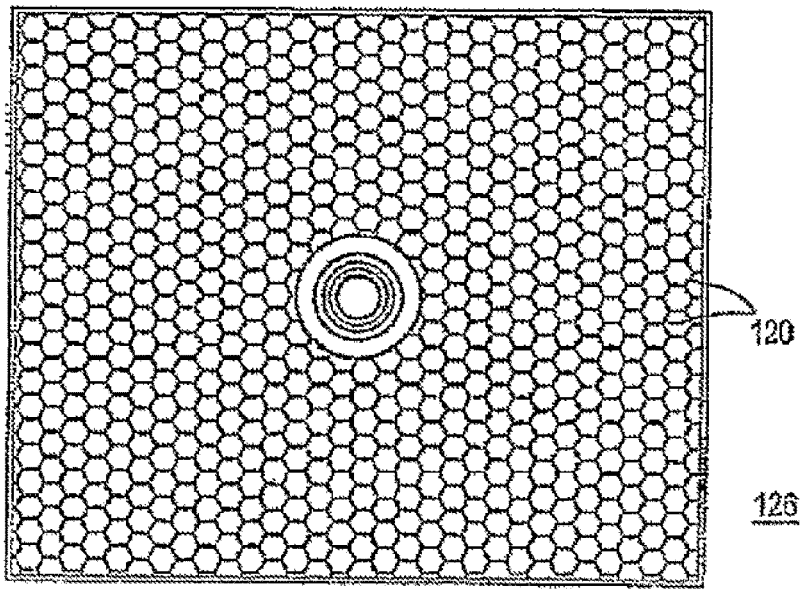
FIG. 9 is a bottom plan view of a prefabricated shower module, illustrating an exemplary honeycomb support rib arrangement, in accordance with another alternative embodiment of the present invention.
Figure 10:
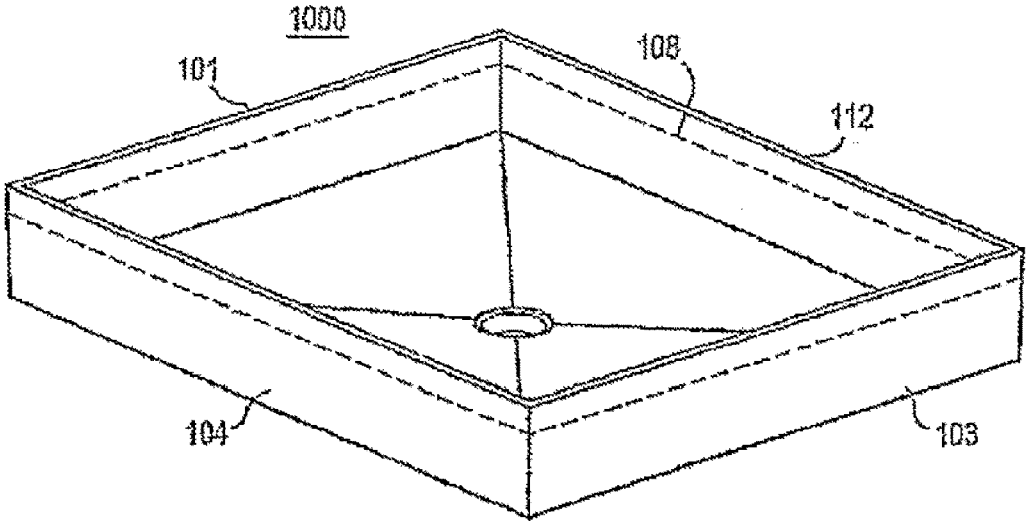
FIG. 10 is a front/top perspective view of a prefabricated shower module having pre-scored indentations for attaching a modular curb along any sidewall, in accordance with another alternative embodiment of the present invention.

In another alternative embodiment, as shown in FIG. 4B, the shower module 800 includes a floor 110 that extends in a horizontal plane from each sidewall 101, 102, 103, 104 and/or peripheral edge to a drain wall 132 surrounding the drain aperture 130. Pitching ribs 121 extend upwards from the upper surface 112 and terminate in an upper edge sloping downwards from the peripheral edge to the drain aperture 130.

In one embodiment, at least one sidewall 104 has a height that is lower than the height of the remaining sidewalls 101, 102, 103. The height of the lower sidewall 104 is preferably at least one inch lower than the height of the remaining sidewalls 101, 102, 103. The lowered height insures that in the event that the plumbing connection becomes clogged, any standing water in the shower module 100 will spill over onto the floor of the bathroom in which the shower enclosure is constructed instead of seeping into the walls; preventing water damage or mold accumulation. Additionally, the top surface of any sidewall 101, 102, 103, 104 should either be flat or pitched towards the shower module 100 so that any water accumulating on the top surface flows back into the shower module 100.

The height of the lower sidewall 104 is preferably sufficient to permit installation of a modular curb 300 (see FIG. 21) adjacent to the sidewall 104. The lower sidewall 104 may be initially molded to the required height, molded to the same height as the other sidewall 101, 102, 103 and trimmed as a part of post-production process, or may contain a horizontal fatigue line 108 (see FIG. 10) located at a height suitable for a portion of the sidewall 104 to be removed, thereby allowing installation of a modular curb adjacent to the sidewall. The horizontal fatigue line 108 denotes a thinner section of the sidewall 104 and can be easily broken, or cut, and removed. The fatigue line 108 may be molded into the sidewall during an injection molding process, or pre-scored by the manufacturer. The fatigue line 108 may be included on any or all of the sidewalls 101, 102, 103, 104 so that an installer may have the option of choosing a sidewall 101, 102, 103, 104 for attaching the prefabricated modular curb 300. After installation of tile on the surface of the shower module 100, any inherent weakness in a sidewall 101, 102, 103, 104 still containing a horizontal fatigue line 108 does not affect the integrity of the shower enclosure and is obscured by the tile.

The outer surface of the lower sidewall 104 may include an attachment feature 106 (see FIG. 23) for engaging a corresponding attachment feature 316 of a modular curb 300. Exemplary methods for attaching the modular curb 300 to the shower module 100 are discussed in greater detail in Section 2. The attachment feature 106 may be a tab, a notch, a slot, a tongue, a groove, a ridge, a peg, an aperture, an interlocking clip, an adhesive material, or any other structure suitable for connecting the modular curb 300 to the shower module 100.

The shower module 100 may constructed using polyurethane reaction injection molded processes. When using injection-molding techniques, the shower module 100 may be molded from a polymeric material such as polyurethane foam having a density equal to or greater than 12 pounds per cubic foot. A lower density polyurethane material would be, most likely, unable to support a connection to the drain.

Figure 11:
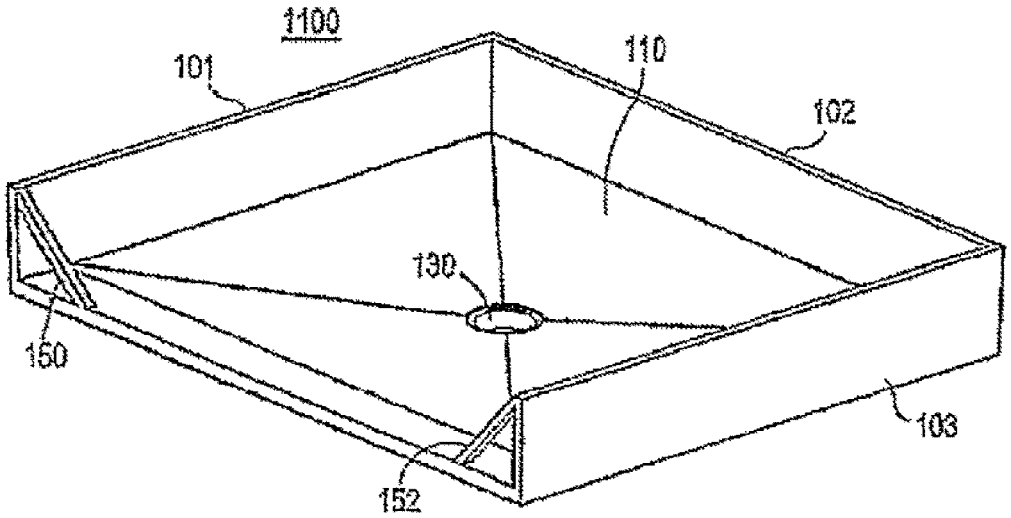
FIG. 11 is a front/top perspective view of a handicapped-accessible prefabricated shower module in accordance with an alternative embodiment of the present invention.
Figure 12:
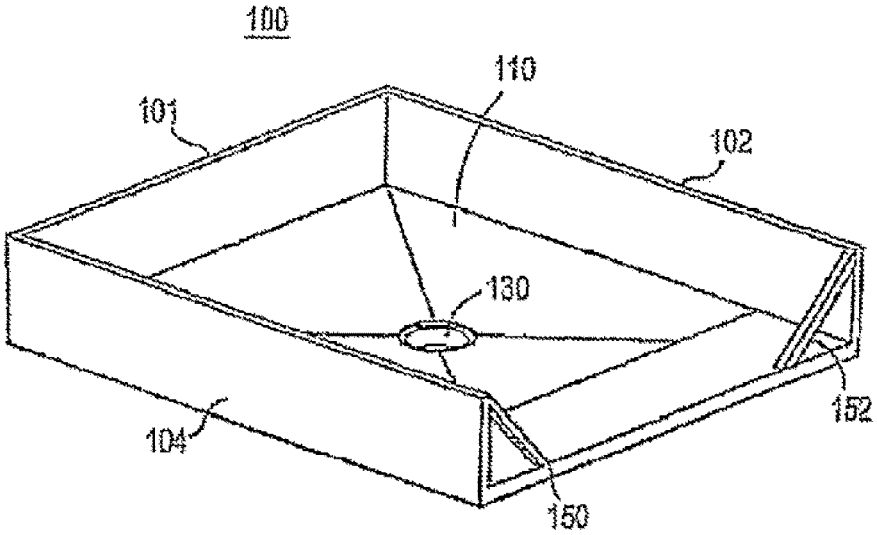
FIG. 12 is a front/top perspective view of a handicapped-accessible prefabricated shower module in accordance with another alternative embodiment of the present invention.
Figure 13:
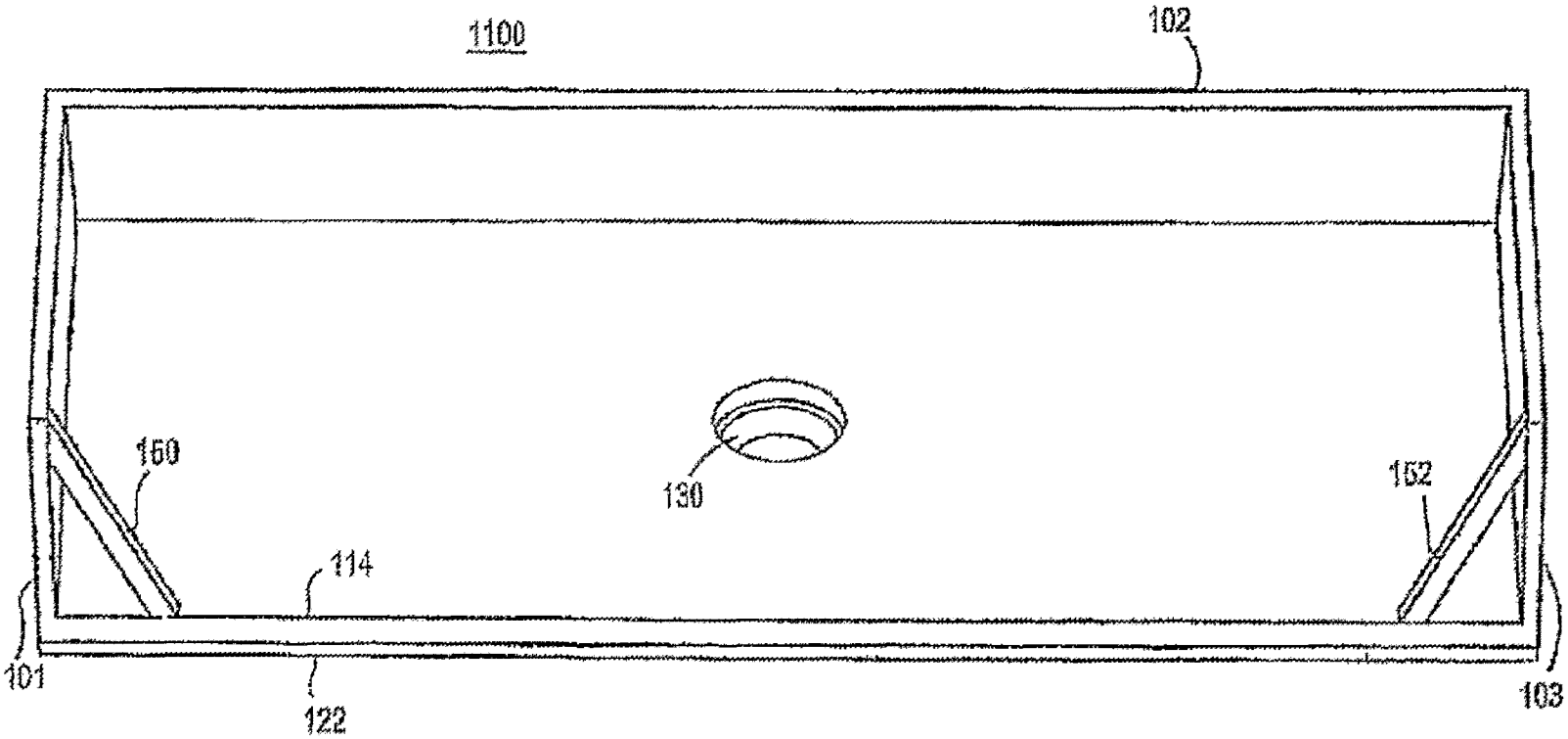
FIG. 13 is a front elevational view of the prefabricated shower module of FIG. 11.

As shown in FIGS. 11-13, at least one peripheral edge of the floor 110 may not be connected to a sidewall. The absence of at least one wall allows the shower module 1100, 1200 to provide access to physically impaired persons and meets requirements established by the Americans with Disabilities Act (ADA), 42 U.S.C. §§12101-12213 (2000). Any sidewall 104 or combination of sidewalls 101, 102, 103, 104 may be partially or completely omitted by placing at least one insert into the cavity of the tool prior to injecting the polymeric material, at a location corresponding to a sidewall 104 of the ADA shower module 1100, 1200. The insert fills all or a portion of the entire void in the tool intended to form the corresponding sidewall 104, thereby preventing polymeric material from flowing into the void and forming the sidewall 104. In this manner, the manufacturer may create a variety of shower modules 100, 1100, 1200 from the same tool, with the only difference being which portion of an entire sidewall 101, 102, 103, 104 is not included (e.g., a sidewall 103 along a longer side of the shower module 1100, a sidewall 104 along a shorter side of the shower module 1200, two sidewalls 102, 104 on opposite edges of the floor 110 to create a "pass-through" shower module (not shown), or two adjacent sidewalls 101, 102 to create a corner shower module (not shown)). The floor 110 of the ADA shower module 1100, 1200 at the entrance to the shower, after having tile installed on the upper surface 112, is virtually flush with the floor of the bathroom in which the shower module 110, 1200 is installed, or slightly raised. Further, the shower module 1100, 1200 is pitched from the peripheral edges of the floor 110 to the drain aperture 130. In this manner, a wheelchair or other mobility-assisting apparatus (e.g., a walker, crutches, a cane, etc.) may freely enter and exit the shower enclosure.

In a similar manner as described above, the height of a sidewall 104 or combination of sidewalls 101, 102, 103, 104 may be lowered to a height suitable for installing a modular curb 300 adjacent to the shower module 100. At least one insert that runs the entire the length of a sidewall 101, 102, 103, 104, or any portion thereof, is placed inside the cavity of the tool prior to injecting the polymeric material, at a location corresponding to a sidewall 104 of the ADA shower module 1100, 1200. The height of the insert corresponds to the difference in height between a full sidewall 101, 102, 103 and the lowered sidewall 104. The insert partially fills the void in the tool intended to form the corresponding sidewall 104, thereby preventing polymeric material from flowing into the void and forming a sidewall 104 having a lowered height. Inserts may be placed within the tool at locations corresponding to any sidewall or combination of sidewalls, thus allowing the manufacturer to create a variety of shower modules with a single tool.

Figure 14:
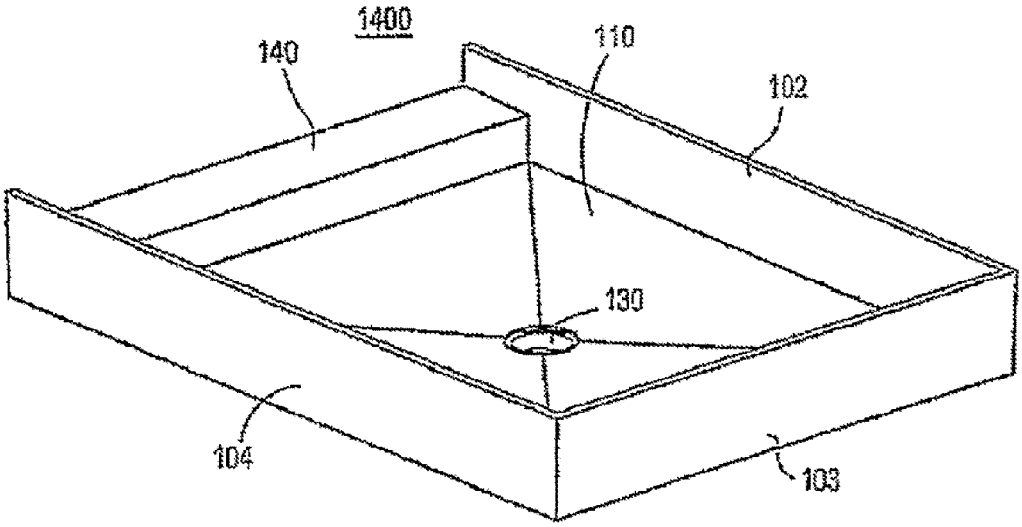
FIG. 14 is a front/top perspective view of a prefabricated shower module having an integrated curb, in accordance with another alternative embodiment of the present invention.
Figure 15:
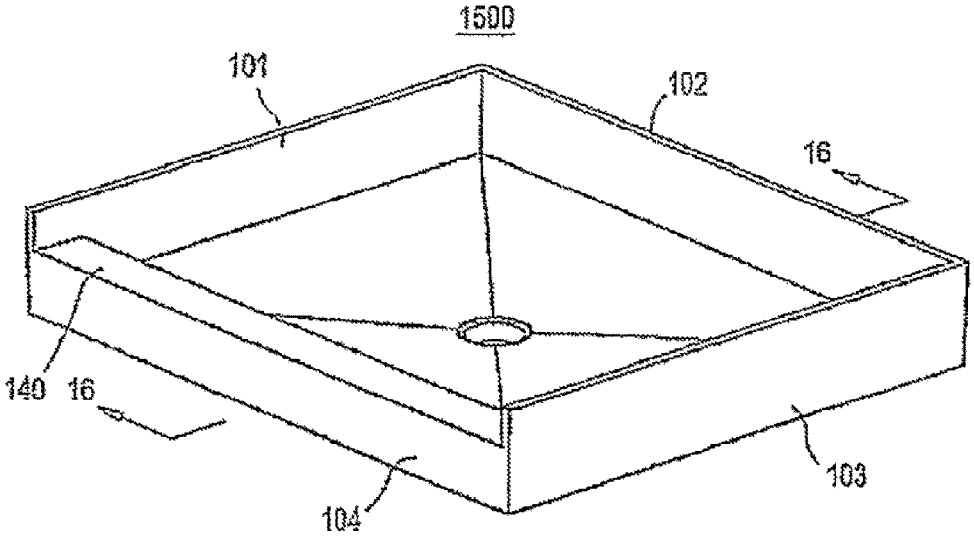
FIG. 15 is a front/top perspective view of a prefabricated shower module having an integrated curb, in accordance with another alternative embodiment of the present invention.
Figure 16:
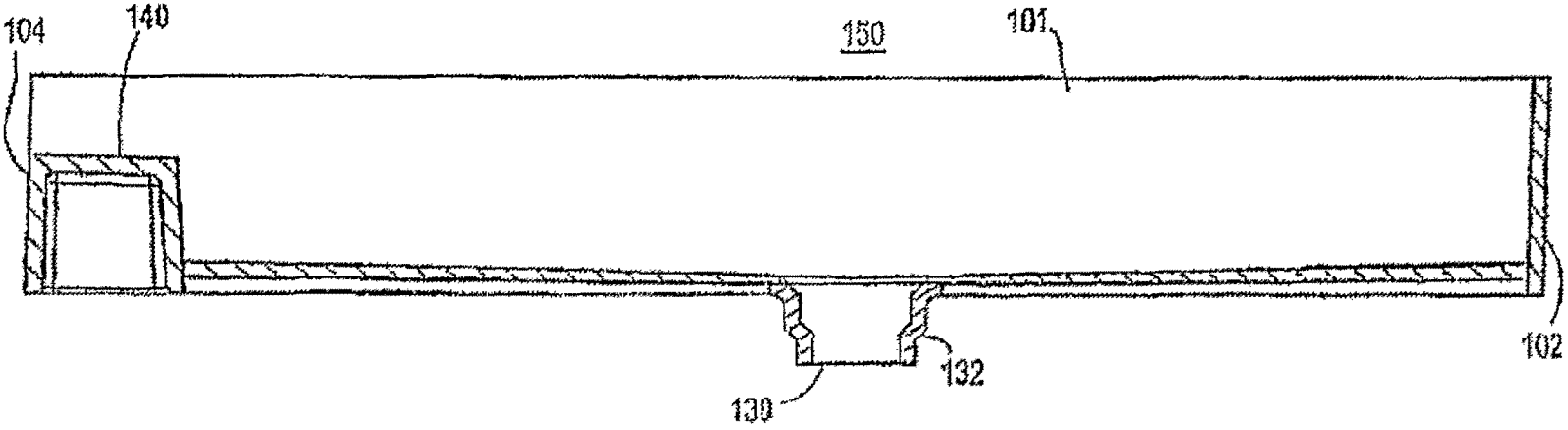
FIG. 16 is a cross-sectional view of the prefabricated shower module of FIG. 15 along the line 16-16.

As depicted in FIGS. 14-16, at least one side wall 104 may include an integrated curb 140 that is molded into the shower module 1500 during fabrication. Similar to the methods described above, the tool may contain voids in the cavity and core, proximate to the location of any sidewall, corresponding to the shape of the integrated curb 140. The manufacturer merely has to place inserts into the tool at the location of the unwanted curb to prevent the integrated curb from forming.

The use of inserts within the tool allows the manufacturer the flexibility of creating a wide variety of shower modules from a single tool. Each tool is an expensive investment. Additional charges are incurred every time a tool is changed out on the manufacturing line. The time required to change the tool is basically wasted time as the line is shutdown in anticipation of the new tool. Placing inserts into the tool, which are comparatively much less expensive than designing and purchasing individual tools for each permutation of sidewall, also allows for a much shorter downtime during the changeover as less time is required to fit or remove an insert than to completely remove and replace the whole tool. Thus, any combination of placement of sidewalls, height of sidewalls, integrated curbs, length of the shower module, and width of the shower module, may be accomplished using a single tool. Additionally, the dimensions of the shower module may be varied by the addition or subtraction of structural features, such as a curb or curbs, extensions, etc., of the module. In this way, the shower module size can be dictated by the designer in such a way as to fit, when coordinated with a feature such as a bench, into an odd-sized enclosure space.

Tile should be retained on the sidewalls 101, 102, 103, 104 and the upper surface 112 of the floor 110 using a resin based epoxy. The epoxy may contain 100% resin solids or resin solids mixed with a solvent, provided the epoxy contains 60% or more resin solids.

Method of Manufacturing.

Figure 17:
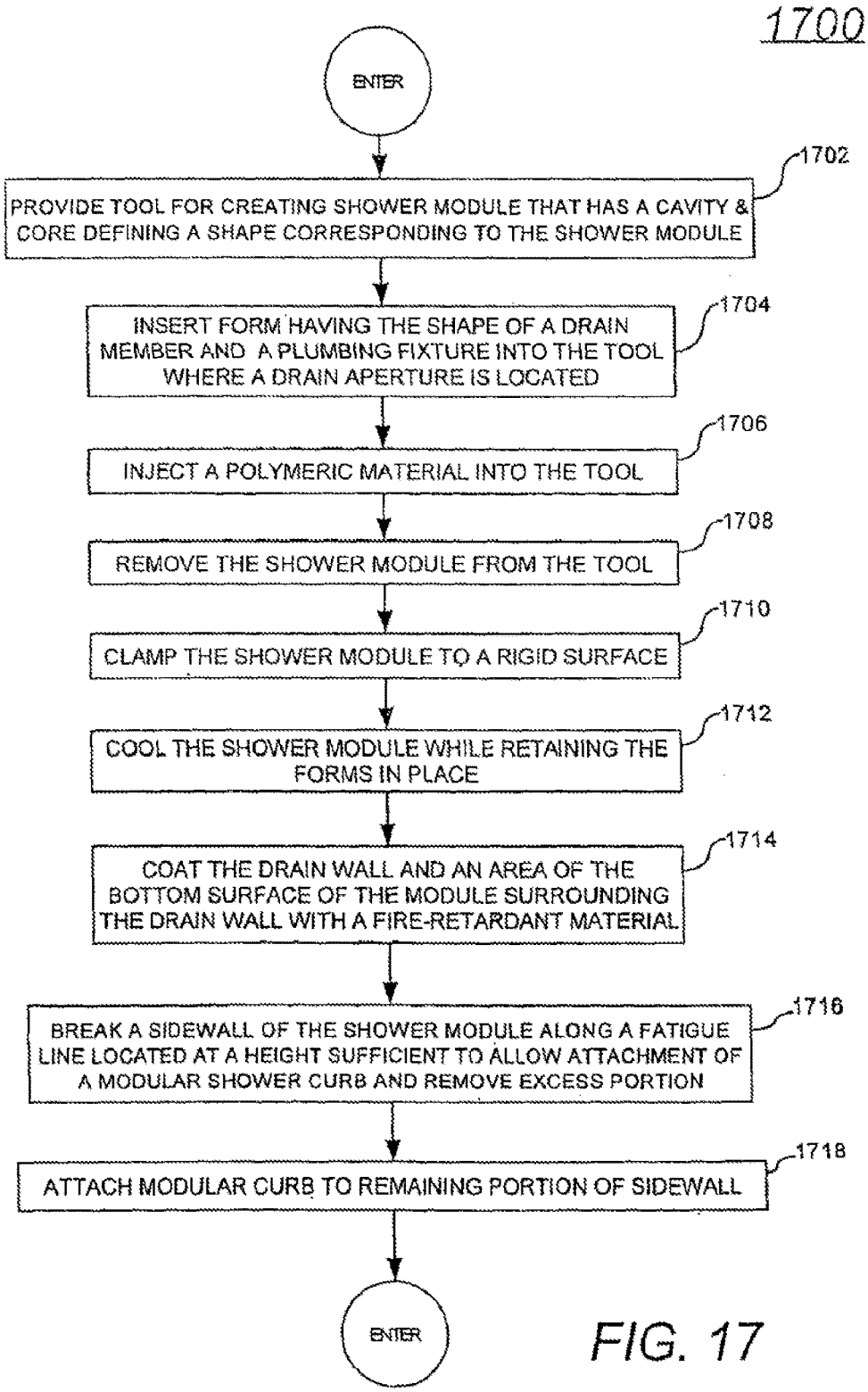
FIGS. 17-18 are logic flow diagrams of various steps executed to implement a method for manufacturing an improved, prefabricated leak-proof shower module, in accordance with exemplary embodiments of the present invention.

FIG. 17 illustrates an exemplary logic flow diagram 1700 executed by a manufacturer to implement a method for creating improved prefabricated shower modules suitable for use in constructing a tiled shower as described above. The manufacturer provides (1702) a tool for creating the leak-proof shower module 100. The tool includes a cavity and a core which define a shape corresponding to a shape of the leak-proof shower module 100. The shower module 100 may contain any, all, or a combination of the features detailed, supra, in Section 1. For example, the manufacturer may provide indentations in the tool that result in the formation of the support ribs 120 or the pitching ribs. The manufacturer may also place one or more inserts into a voided area of the tool (i) that corresponds to a sidewall 101, 102, 103, 104 of the shower module 100, thereby preventing the polymeric material from filling the voided area during injection molding, or (ii) corresponds to a portion of the length or width of the shower module thereby preventing the polymeric material from filling the voided area during injection molding. In addition, the manufacturer may mold a horizontal fatigue line 108 into one or more sidewalls 101, 102, 103, 104 by creating a raised tab along the length a voided area that corresponds to the sidewall 101, 102, 103, 104 at a height suitable for removing a portion of the sidewall 101, 102, 103, 104 and attaching a modular curb 300.

Next, the manufacturer inserts (1704) one or more forms into the tool between the cavity and the core at the location established for the drain aperture 130 for the purpose of forming the drain aperture 130 in the floor 110 and the drain wall 132 of the shower module 100. The drain aperture 130 may have a uniform diameter or the drain aperture 130 may have one or more diameters along the bottom portion of the drain aperture 130 for inserting all or a portion of a drain fixture 135 for connecting to the plumbing line, and a wider diameter at the top portion of the drain aperture 130 for inserting all or a portion of a plumbing fixture to accommodate a drain fixture top having a wider or variable diameter. Thus, the form may have a uniform diameter, or may contain a first portion corresponding to a drain fixture shape suitable for connecting to a plumbing line and a second portion corresponding to a drain fixture shape suitable for accommodating a the drain top of drain fixture 135. Alternatively, two forms may be used, wherein one form corresponds to a shape suitable for connecting to a plumbing line and the second form corresponds to a shape suitable for connecting to a plumbing line. A drain aperture reinforcing structure 136 may also be placed in the drain wall 132 and the floor 110 surrounding the drain aperture 130 to strengthen the area around the drain aperture 130.

Next, the manufacturer injects (1706) a polymeric material into the tool to produce the leak-proof shower module 100. The polymeric material should be injected into the tool such that the material flows in a direction unimpeded by any support rib 120. Thus, the polymeric material should flow in a direction parallel, perpendicular, or at an angle of 90° or less to any support rib 120 of the plurality of support ribs 120 or to any pitching ribs 121 of the plurality of pitching ribs 121.

The shower module 100 is cooled in the tool and as it cools, the polyurethane hardens and cures. Before it is completely cooled and cured, it may be removed (1708) from the tool and clamped (1710) to a rigid surface (e.g., a table, a workbench, etc.) while the shower module continues to cool (1712) and cure. Thus, the possibility of warping or bowing of the lower surface 114 or the upper surface 112 of the floor 110 of the shower module 100 is minimized. Additionally, the shower module 100 may actually spend less overall time in the tool before being removed as the steps taken during post-molding decrease the effects of any warping or bowing, thus allowing the shower module 100 to be removed faster than what would typically be acceptable. Thus, the manufacturing cycle-time per unit is reduced, which may reduce the total cost of the product.

After the shower module 100 has cooled to a solid condition (before or after removing the clamps) the manufacturer may coat (1714) the drain wall 132 and an area on the bottom surface 114 of the floor 110 surrounding the drain wall 132 with a fire-retardant material.

Additionally, the shower module 100 may be modified to allow a modular curb 300 to be attached to a sidewall 101, 102, 103, 104 of the shower module 100. The modification may be made by breaking (1716) the selected sidewall 101, 102, 103, 104 along a horizontal fatigue line at a height sufficient to allow attachment of a modular curb 300 thereto, and removing the excess portion. Alternatively, the sidewall 101, 102, 103, 104 may be cut to the appropriate height. Finally, the modular curb 300 is attached (1718) to the remaining portion of the sidewall 101, 102, 103, 104 by either the manufacturer (e.g., prior to shipment) or the installer (e.g., in the field).

After fabrication of the shower module 100 having a drain aperture 130 made for a drain fixture 135, the drain fixture 135 is inserted into the drain aperture 130 and a water-tight seal is formed at one or more of (i) the upper surface 112 of the floor 110 at or around the drain aperture 130, (ii) the drain aperture 130, and (iii) the lower surface 114 of the floor 110 at or around the drain aperture 130.

Figure 18:
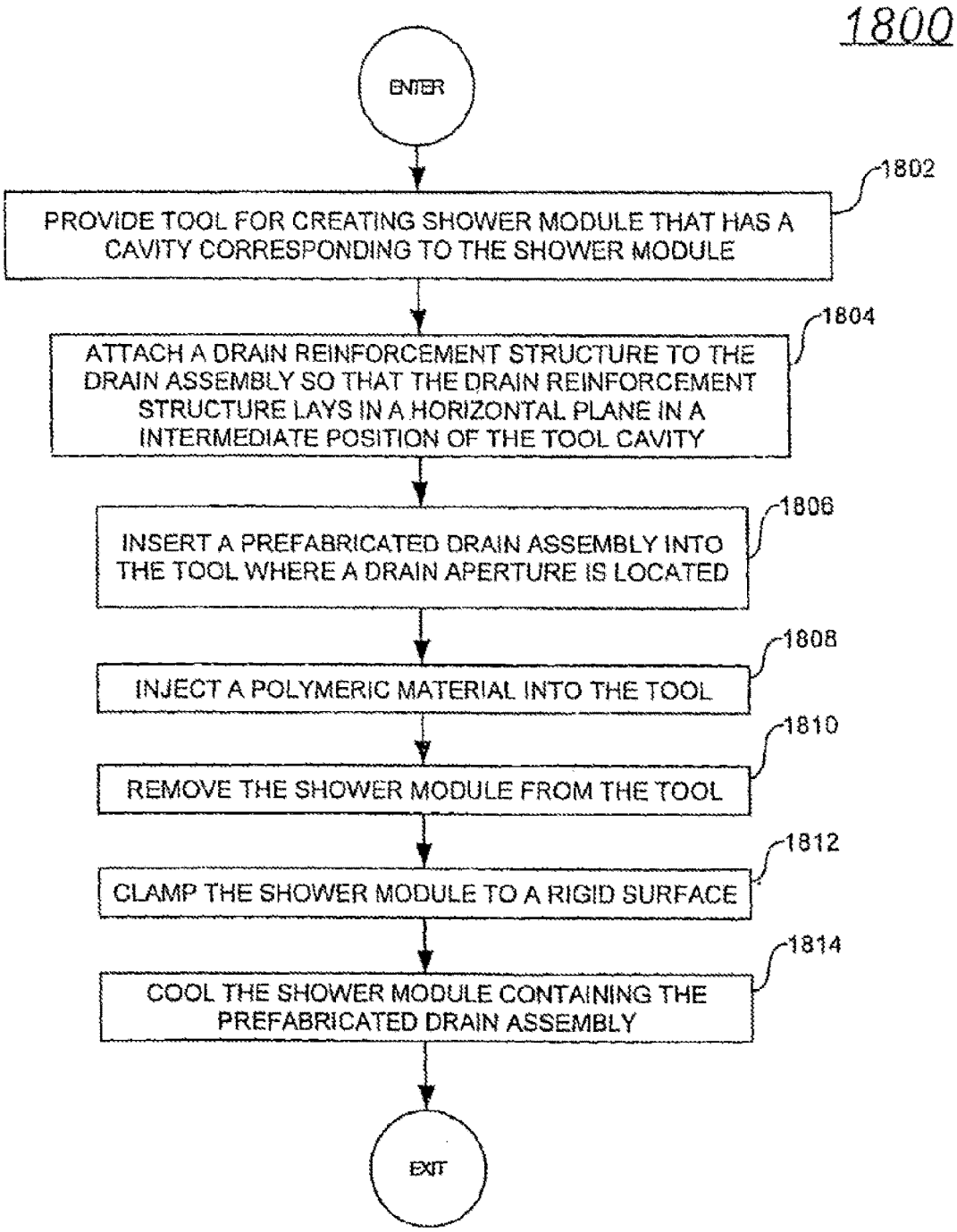

In an alternative embodiment, as illustrated in FIG. 18 by the exemplary logic flow diagram 1800, a prefabricated drain assembly 134 may be embedded within the floor 110 and drain wall 132 of the shower module 100 during injection molding. Similar to the above process, the manufacturer begins by providing (1802) a tool for creating the shower module 100. The tool includes a cavity portion and a core portion which define a shape corresponding to a shape of the shower module 100. As above, the shower module 100 may contain any, all, or a combination of the features detailed, supra, in Section 1.

Next, the manufacturer attaches (1804) a drain reinforcing structure 136, which contains an opening in the center, to a prefabricated drain assembly 134 in such a manner that the edges of the interior diameter of the drain reinforcing structure 136 interfere with the outer diameter of the prefabricated drain assembly 134. The drain assembly 134 with the attached drain reinforcing structure 136 is then inserted (1806) inside the tool at a location corresponding to the location of the drain aperture 134 such that the drain reinforcing structure 136 lies in a horizontal plane in an intermediary position between the cavity and the core of the tool. Next, the manufacturer injects (1808) a polymeric material into the tool, thereby embedding the drain reinforcement structure 136 in the shower module 100 and integrating the drain assembly 134 within the floor 110 of the shower module 100. As above, the polymeric material should be injected into the tool such that the material flows in a direction unimpeded by any support rib 120. The manufacturer removes (1810) the integrated shower module 100 from the tool, clamps (1812) the shower module 100 to a table (or other rigid surface) to prevent movement, and allows the integrated shower module to cool (1814) while still clamped to the table.

The Prefabricated Modular Curb.

Figure 19:
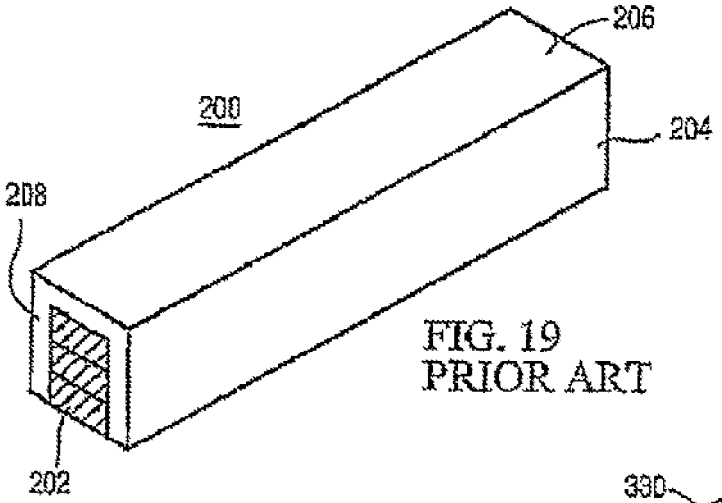
FIG. 19 PRIOR ART
FIG. 19 is a front/top perspective view of a prior art modular curb.
Figure 20:
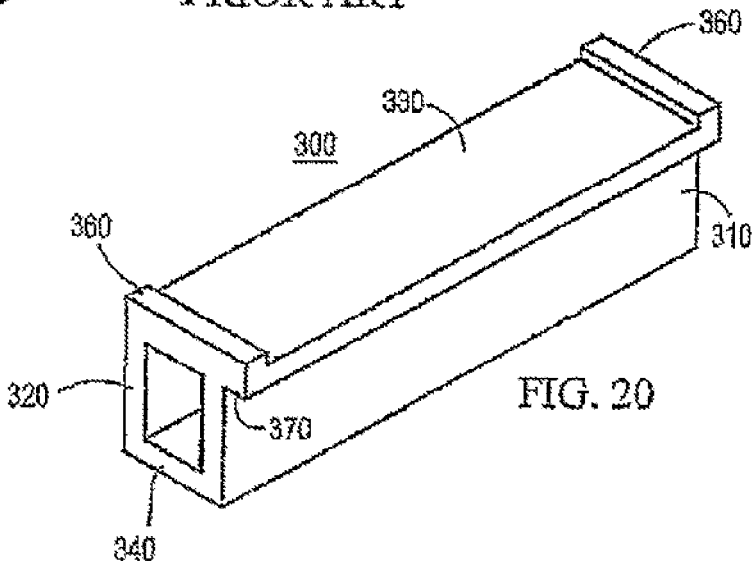
FIG. 20 is a front/top perspective view of a prefabricated modular curb in accordance with one embodiment of the present invention.
Figure 21:
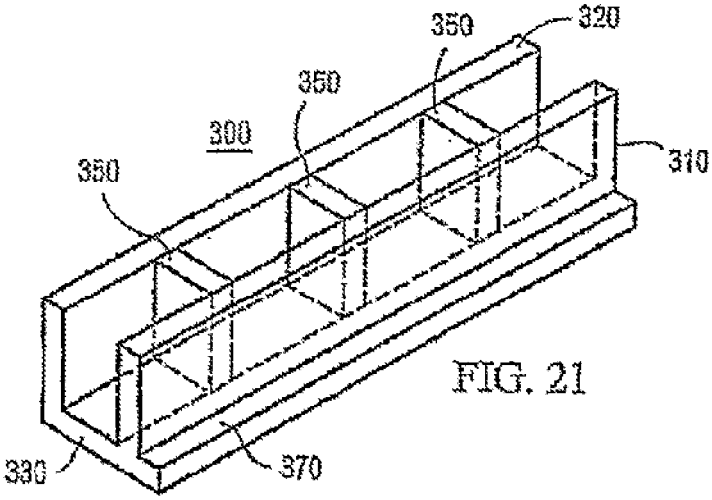
FIG. 21 is a front/bottom perspective view of a prefabricated modular curb in accordance with one embodiment of the present invention.

Generally, when constructing a tiled shower enclosure, installers build a curb at the intersection of the shower enclosure and the bathroom floor that serves as a dam to prevent water from escaping onto the floor. Typically, the curb was simply constructed by vertically stacking two or three wooden 2×4" boards, covering the boards with a leak-proof liner, and applying tile on top of the liner. At least one prefabricated curb 200, as illustrated in FIG. 19, has previously been offered for use in construction of shower enclosures. The prior art curb 200 simply consists of a U-shaped form having a top wall 206, a front wall 204, and a rear wall 208. The distance between the front wall 204 and the rear wall 208 is approximately the width of a standard 2×4 202. The prior art curb 200 is typically designed to receive structural support from 2×4's 202 stacked in the same manner as when a curb is constructed manually.

As shown in FIGS. 20-23, an improved prefabricated modular curb 300 suitable for use in constructing a tiled shower, in conjunction with a shower module 100, and method of installation is disclosed. The modular curb 300 includes an exterior wall 320, a top wall 330, and a mounting wall 310 that engages a sidewall 101, 102, 103, 104 of a shower module 100 when installed proximate to the shower module 100. The top wall 330 extends perpendicularly from the upper edge of the exterior wall 320 to the upper edge of the mounting wall 310. Alternatively, the exterior wall 320 may be taller than the mounting wall 310 such that the top wall 330 is pitched to slope downwards toward the sidewall 101, 102, 103, 104 of the shower module 100 when the modular curb 300 is installed adjacent to the sidewall 300. The outer surface of the exterior wall 320 and the outer surface of the top wall 330 are suitable for retaining tile, stone, and/or marble using an epoxy containing 100% resin solids or resin solids mixed with a solvent.

The modular curb 300 may also, but not necessarily, include a bottom wall 340 that extends from the bottom edge of the exterior wall 320 to the bottom edge of the mounting wall 310, and opposite to the top wall 330. At least one reinforcing curb rib 350 is attached to at least one of to the top wall 330, the inner surface of the mounting wall 310, the inner surface of the exterior wall 320, the bottom wall 340 (if present), or any combination thereof. The reinforcing curb rib 350 runs perpendicular to, parallel to or at an acute angle to the mounting wall 310 or the exterior wall 320.

The combination of the modular curb 300 with the shower module 100 offers significant improvements over the prior art by combining a leak-proof shower module with an attached leak-proof mounting wall, thereby maintaining the leak-proof quality of the overall shower base system. In addition, the modular curb 300 may be manufactured from a single tool using a combination of inserts. Each insert corresponds to the cross-sectional shape of the modular curb 300, but has varying lengths. By placing or removing one or more inserts, the length of the prefabricated modular curb 300 may be customized through the manufacturing process. Alternatively, the modular curb 300 may simply be cut to the desired length after fabrication.

In one embodiment, the top wall 330 may include a horizontal lip 360 on the upper surface along the length of one or both ends. The horizontal lip 360 should be at least 1 inch tall and at least ⅜ inches wide so that a standard-sized wallboard may rest on the lip 360. Additionally, the curb 300 may include a reinforcing curb rib 350 at one or both ends, connected perpendicularly to the exterior wall 320 and to the mounting wall 310 and effectively enclosing the corresponding end.

Figure 22:
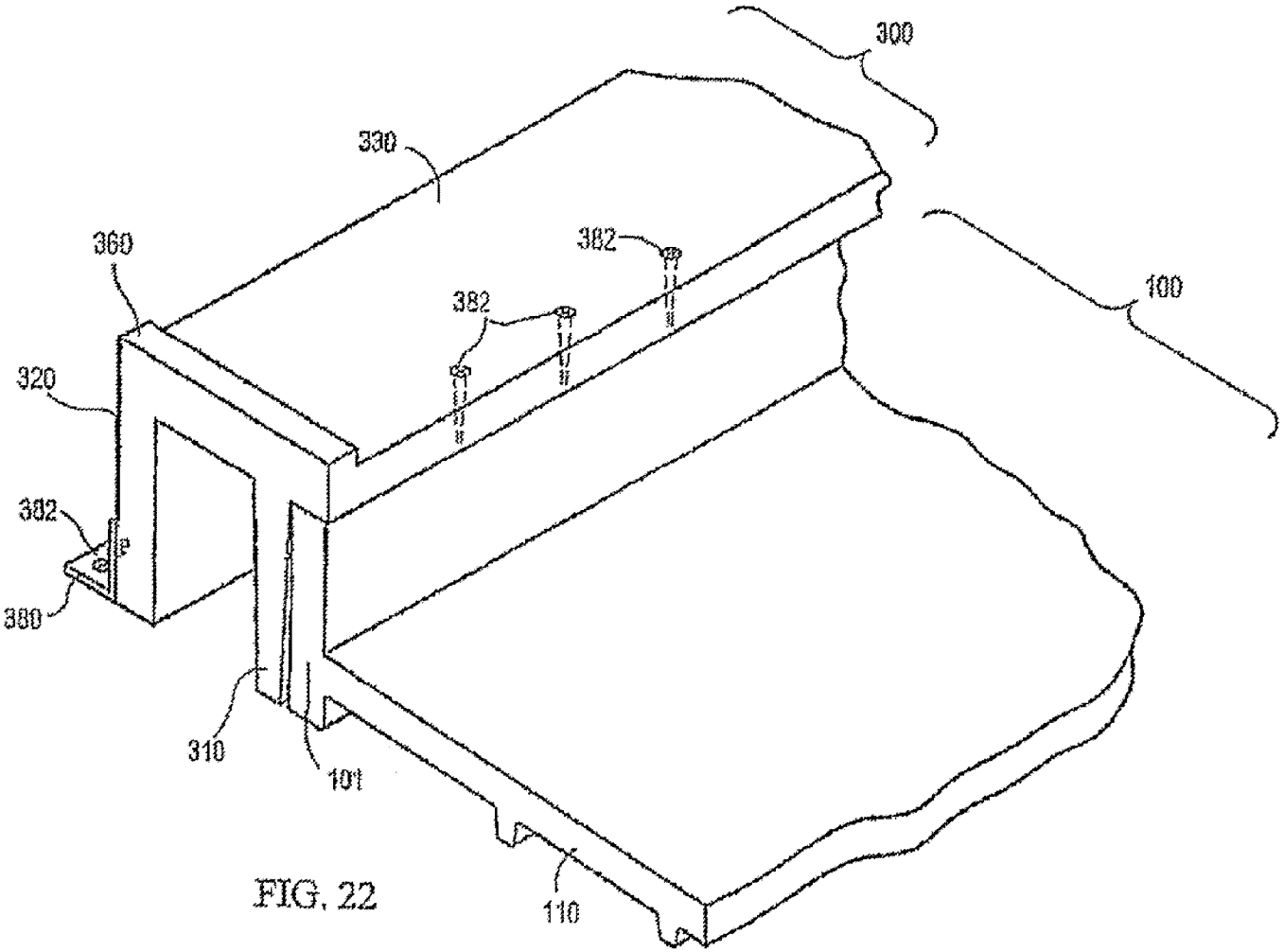
FIG. 22 is a side/top perspective view illustrating an exemplary installation of the modular curb of FIG. 21 with the shower module of FIG. 1.

In another embodiment, the top wall 330 extends beyond the outer surface of the mounting wall 310 to terminate in a ledge 370 having a width substantially equal to the width of the sidewall 101, 102, 103, 104 of the shower module 100 (see FIG. 22). Thus, when the modular curb 300 is installed adjacent to the shower module 100, the ledge 370 extends over the top of the sidewall 101, 102, 103, 104 and the outer edge of the ledge 370 is substantially flush with the inner surface of the sidewall 101, 102, 103, 104.

Figure 23:
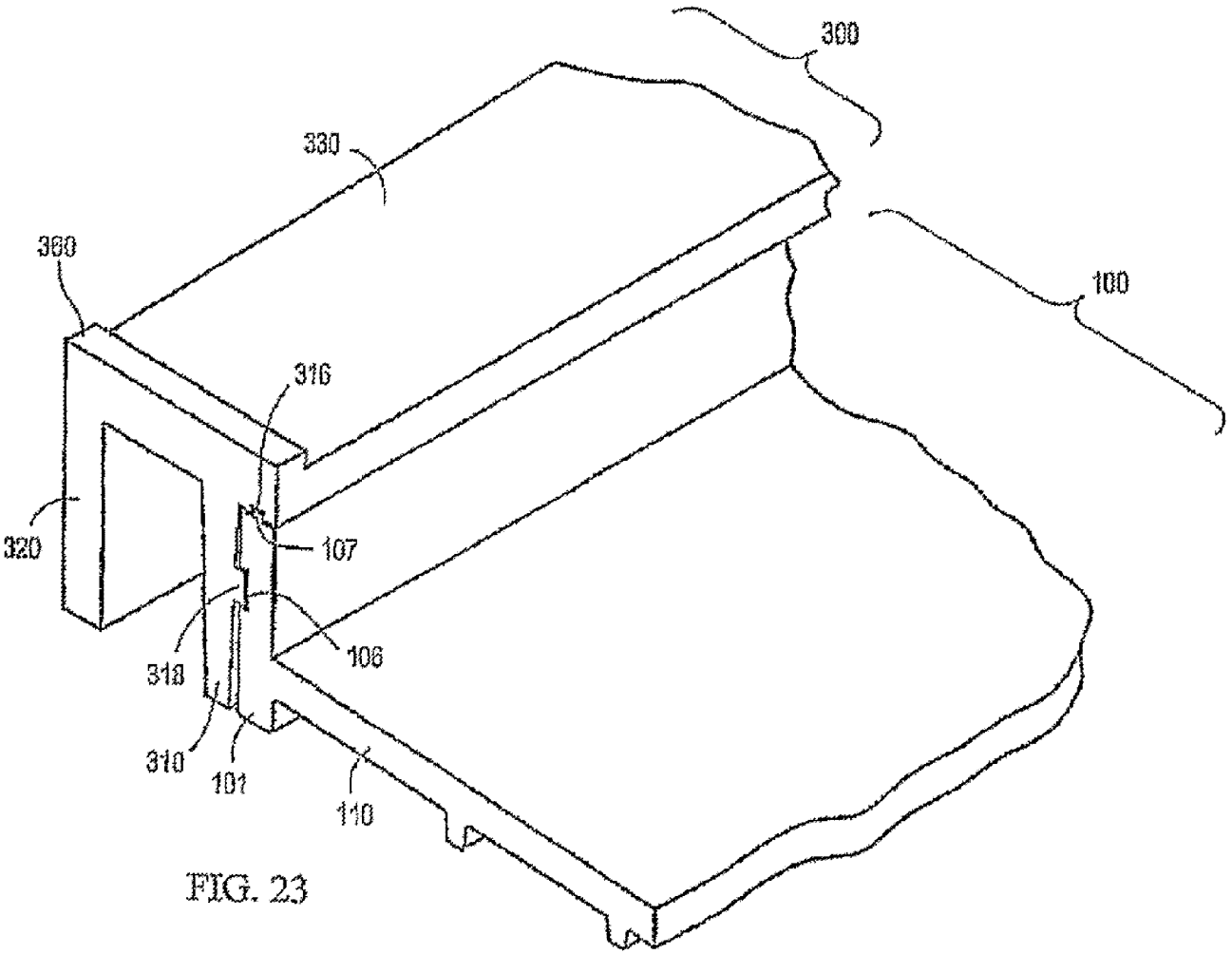
FIG. 23 is a side/top perspective view illustrating an exemplary installation of an alternative embodiment of a modular curb in accordance with an exemplary embodiment of the present invention.

In an alternative embodiment, as shown in FIG. 23, the modular curb 300 may also include an attachment feature 316, 318 located along the outer surface of the mounting wall 310 for engaging a corresponding attachment feature 106 in the sidewall 101, 102, 103, 104 of the shower module 100. The modular attachment feature 316, 318 may be a tab, a notch, a slot, a tongue, a groove, a ridge, a peg, an aperture, an interlocking clip, or any combination thereof.

In one embodiment, the modular curb 300 may be constructed using similar polyurethane reaction injection molding techniques as described above in relation to the prefabricated shower module 100. The process of molding the modular curb 300 faces some similar issues as when molding the shower module 100. For instance, the direction of flow of the polymeric material should be unimpeded by the reinforcing curb ribs 350 during injection molding in order for the material to flow properly. Thus, the reinforcing curb ribs 350 should run parallel to or at an angle of 90° or less to the direction of flow of polymeric material. Additionally, to provide the proper support, the modular curb 300 should be molded from a polyurethane foam (which may also be fire-retardant) having a density of 12 pounds per cubic foot or greater.

Figure 24:
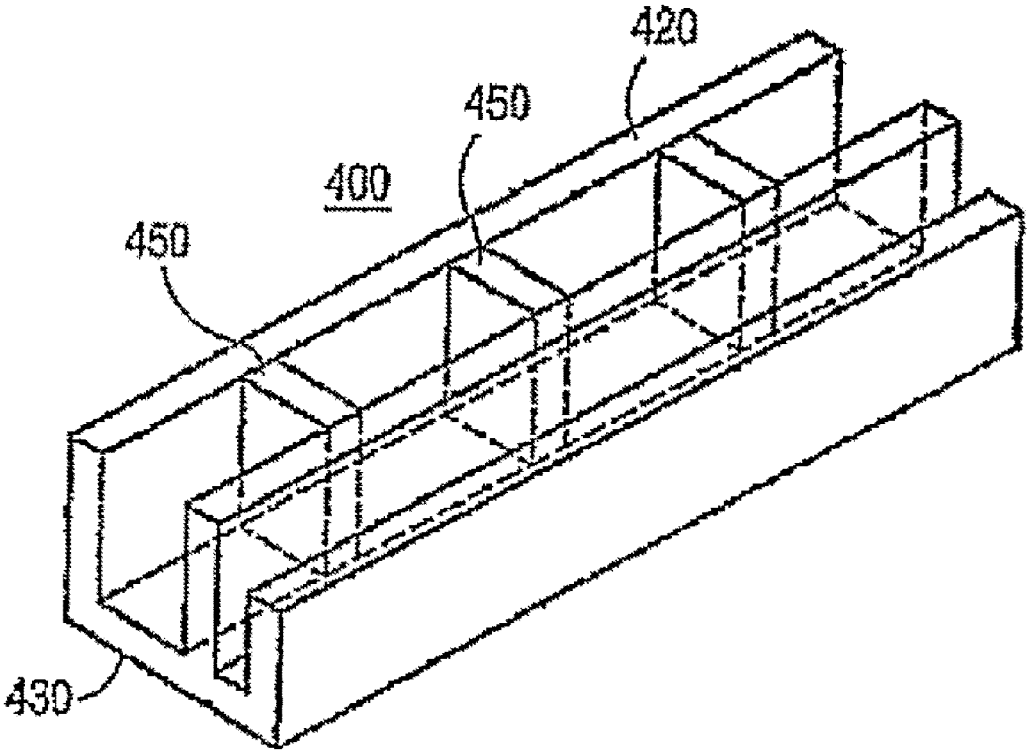
FIG. 24 is a front/bottom perspective view of a prefabricated modular curb in accordance with an alternative embodiment of the present invention.
Figure 24A:
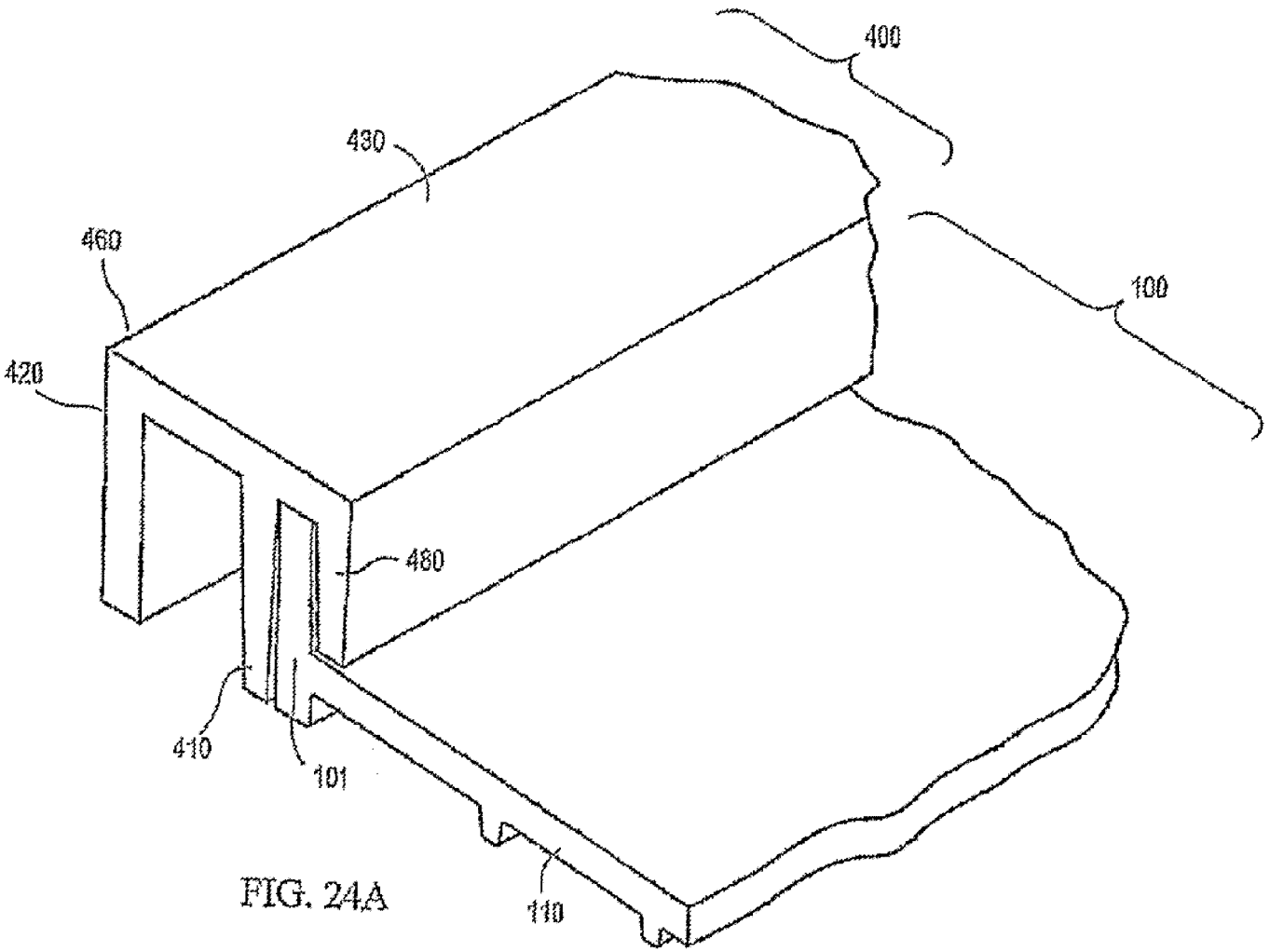
FIG. 24A is a side cross-sectional view illustrating an exemplary installation of an alternative embodiment of a modular curb in accordance with an exemplary embodiment of the present invention.

In another alternative embodiment, as shown in FIGS. 24-24A, a prefabricated modular curb 400 includes an outer mounting wall 410, an inner mounting wall 480, an exterior wall 420, and a top wall 430. The top wall 430 is attached substantially perpendicular to the upper edge of the exterior wall 420, to the upper edge of the inner mounting wall, and to the upper edge of the outer mounting wall 410. The inner mounting wall 480 is located at an intermediary point between the outer mounting wall 410 and the exterior wall 420. The distance from the outer mounting wall 410 to the inner mounting wall 480 is slightly greater than the width of a sidewall 101, 102, 103, 104 of the shower module 100, such that when the curb 100 is mounted adjacent to the shower module 100, the sidewall 101, 102, 103, 104 is retained between the outer mounting wall 410 and the inner mounting wall 480. The exterior wall 420 may be the same height or taller than the inner mounting wall 480 so that the top wall 430 is horizontal or slightly pitched towards the shower module 100 upon installation. The outer mounting wall 410 is shorter than the inner mounting wall 480 and should rest on the floor 110 of the shower module 100 upon installation. Additionally, the modular curb 400 may include reinforcing curb ribs 450 attached to at least one of the top wall 430, the inner mounting wall 480, and the exterior wall 420.

Figure 25:
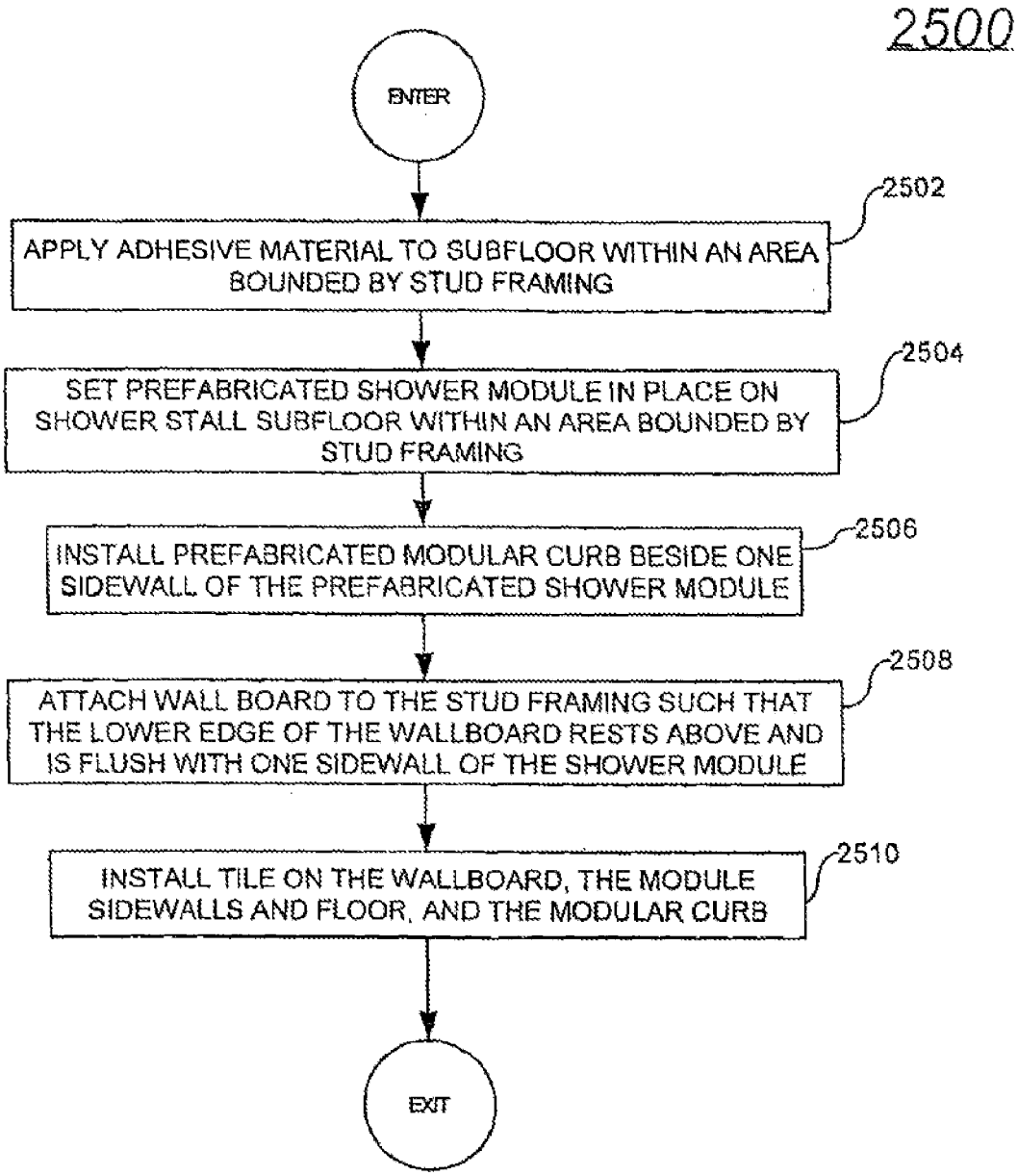
FIGS. 25-27 are logic flow diagrams of various steps executed to implement a method for creating a tiled shower stall using a prefabricated leak-proof shower module and a prefabricated modular curb, in accordance with exemplary embodiments of the present invention.
Figure 26:
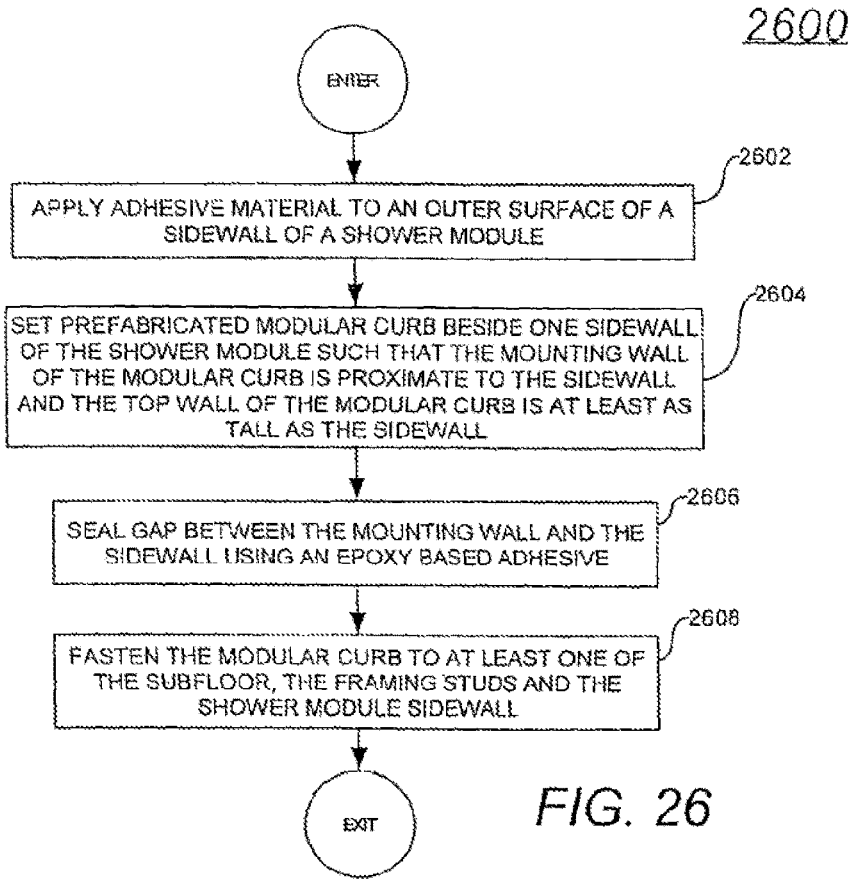
Figure 27:
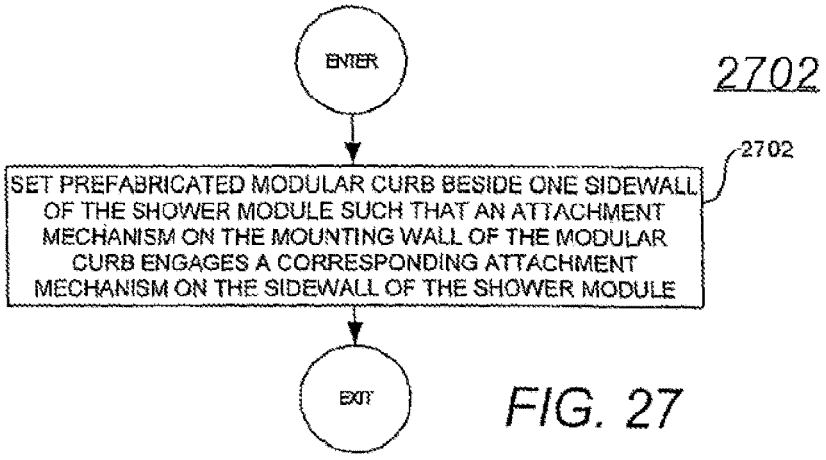

FIG. 25 illustrates an exemplary logic flow diagram 2500 executed by a shower enclosure installer to implement a method for constructing a tiled shower enclosure within an area bounded by a subfloor and stud framing using a prefabricated modular curb 300 and a prefabricated shower module 100. The subfloor includes a plumbing connection that leads to a sewer line or septic tank. The installer begins by applying (2502) a quantity of adhesive material on the subfloor within the area bounded by the stud framing. Next, the installer sets (2504) a prefabricated leak-proof shower module 100 in place on the subfloor within the area bounded by the stud framing. The shower module 100 should be positioned on the subfloor such that the support ribs 120 are in supporting engagement with the subfloor, at least one sidewall 101, 102, 103, 104 is substantially adjacent to the stud framing, and the drain assembly 134 is in fluid communication with the subfloor plumbing connection.

The installer then installs (2506) a prefabricated modular curb 300 adjacent to at least one sidewall that is not adjacent to the stud framing. Exemplary methods of installing the prefabricated modular curb 300 are detailed in the logic flow diagrams of FIGS. 26 and 27. Following the steps for implementing the method detailed by logic flow diagram 2600, the installer applies (2602) a quantity of adhesive material to the outer surface of the sidewall 101, 102, 103, 104 and sets (2604) the modular curb beside the sidewall 101, 102, 103, 104 such that the mounting wall 310 of the modular curb 300 is proximate to the sidewall 101, 102, 103, 104 and the top wall 330 is positioned at the same level or above the top edge of the sidewall 101, 102, 103, 104. Next, the installer seals (2606) any gap between the mounting wall 310 and the sidewall 101, 102, 103, 104 using an epoxy based adhesive to form a water-tight, leak-proof seal. Additionally, or alternatively, the installer may fasten (2608) the modular curb to the subfloor, the framing studs, or the sidewall 101, 102, 103, 104 using brackets 380 and screws 382 or any other traditional fasteners (e.g., screws, nails, rivets, etc.). In the finished tiled shower enclosure, the fasteners are completely hidden from view by the application of tile.

Alternatively, the installer may set (2702) the prefabricated modular curb 300 adjacent to the sidewall 101, 102, 103, 104 such that an attachment feature 106 (e.g., a tab, a notch, a slot, a tongue, a groove, a ridge, a peg, an aperture, an interlocking clip, etc.) along an outer surface of the sidewall 101, 102, 103, 104 engages with a corresponding attachment feature 316, 318 along the outer surface of the mounting wall 310 of the modular curb 300. The installer may also connect the modular curb 300 to the sidewall 101, 102, 103, 104 of the shower module 100 by inserting one or more screws 382 through the ledge 370, engaging the sidewall 101, 102, 103, 104, as shown in FIG. 22.

Referring back to FIG. 25, after installing the modular curb 300, the installer then attaches (2508) wallboard to the framing such that a lower edge of the wallboard rests above and is flush with any sidewall 101, 102, 103, 104 adjacent to the stud framing. Finally, the installer installs (2510) tile on the wallboard, the module sidewalls 101, 102, 103, 104, the floor 110, and the modular curb 300, thereby resulting in a tiled shower.

The Shower Bench and Ledge.

Figure 28:
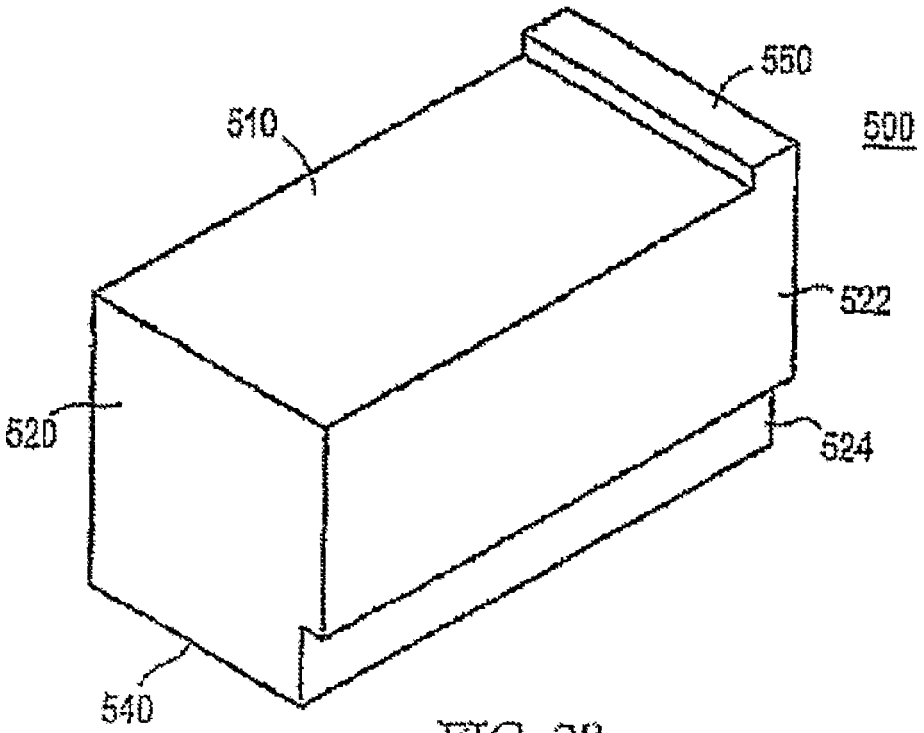
FIG. 28 is a front/top perspective view of a prefabricated shower seat in accordance with an embodiment of the present invention.
Figure 29:
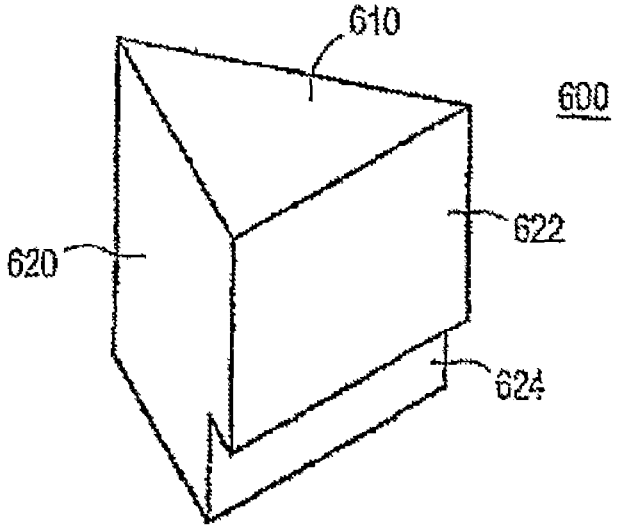
FIG. 29 is a front/top perspective view of a prefabricated shower seat in accordance with an alternative embodiment of the present invention.
Figure 30:
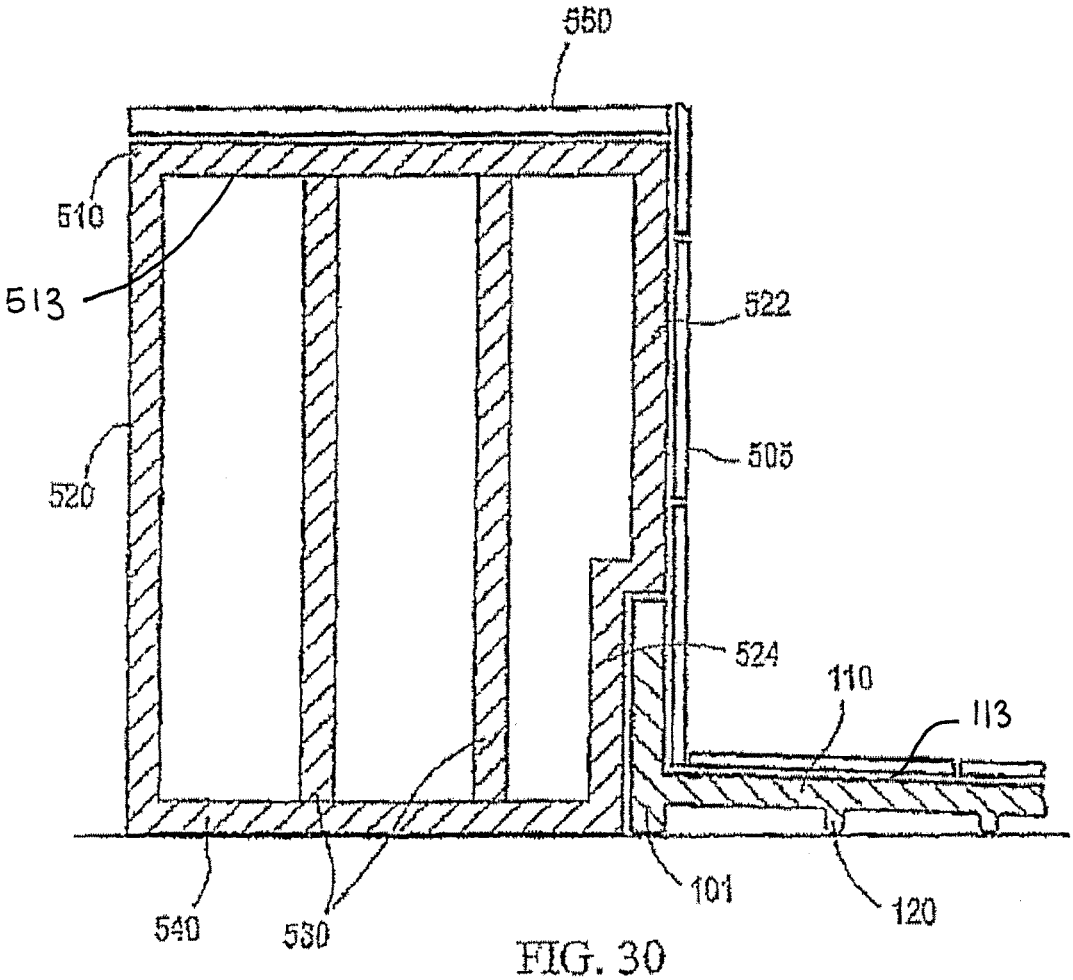
FIG. 30 is a side elevational view illustrating an exemplary installation of the prefabricated shower seat of FIG. 28 installed with a prefabricated shower module of FIG. 1, in accordance with an embodiment of the present invention.

Another component of the leak-proof modular shower enclosure system includes a shower bench or ledge, as illustrated in FIGS. 28-30. The combination of the bench and ledge with the shower module 100 offers significant improvement over prior art by attaching a leak-proof shower bench or ledge to a leak-proof shower module, at an attachment point that is also leak-proof, thereby maintaining the leak-proof integrity of the shower base system. In addition, the shower bench and shower ledge may each be made in their own tool using a combination of inserts, which permit the shower bench and the shower ledge to be made with a variable height, variable length, and variable depth so that the shower bench and the shower ledge can be customized either through the manufacturing process or after fabrication by cutting the shower bench and the shower ledge to the desired dimensions. The term "shower ledge" includes any structure, regardless of specific height, width, or length and having a substantially horizontal surface, for use in constructing a tiled shower enclosure. A "shower ledge" may or may not be intended to support the weight of a person or persons. Thus, the use of the term "shower bench," as used in the context of the following discussion is interchangeable with the term "shower ledge." Typically, a "shower bench" is simply a shorter version of a "shower ledge."

In one embodiment, the shower bench 500 is designed for installation between the shower module 100 and a stud-framed wall of the tiled shower enclosure. The shower bench 500 may include a rectangular seating member 510, as shown in FIG. 28, connected to an upper edge of a sidewall 520 along each peripheral edge. The length of the shower seat 500 is preferably equal to either the width or the length of the corresponding shower module 100 with which the shower bench 500 will be installed. The lower edge of each sidewall 520 terminates in a common plane that either rests on the subfloor of the shower enclosure or connects to a corresponding peripheral edge of an optional bottom plate 540. The seat 500 may be tilted slightly from a horizontal plane to that water may run off of this seat (on the tile applied thereto).

One sidewall 520 is divided into an upper portion 522 and a lower portion 524, wherein the lower portion is set back from the upper portion 522 along the entire length of the shower bench 500. The lower portion 524 is taller than the height of a sidewall 101, 102, 103, 104 of the shower module 100, and is set back from the upper portion 522 a distance slightly greater than the thickness of the sidewall 101, 102, 103, 104 of the shower module 100. In this manner, when the shower bench 500 is installed adjacent to the sidewall 101, 102, 103, 104 of the shower module 100 such that the sidewall 101, 102, 103, 104 of the shower module 100 resides within the setback area, thereby preventing the weight of the shower bench 500 from resting on the sidewall 101, 102, 103, 104 of the shower module 100. Additionally, as shown in FIG. 30, the outer surface of the upper portion 522 of the shower bench sidewall 520 should be flush (i.e. substantially coplanar) with the inner surface of the sidewall 101 so that when tile 505 is installed to form the final shower enclosure, the transition between the shower module 100 and the shower bench 500 is unnoticeable.

In an alternative embodiment, as shown in FIG. 29, the shower bench 600 includes a triangular seating member 610 connected to an upper edge of a sidewall 620 along each peripheral edge. The seating member 610 may be any geometric shape suitable for forming a shower enclosure. Similar to shower bench 500, one sidewall 620 is divided into an upper portion 622 and a lower portion 624, wherein the lower portion is set back from the upper portion 622 along the entire length of the shower bench 600, allowing the shower bench 600 to be installed adjacent to a prefabricated shower module 100 without the weight of the shower bench resting upon the sidewall 101, 102, 103, 104 of the shower module 100.

In one embodiment of the present invention, the shower bench 500 may include at least one support rib 530 attached to at least one of the seating member 510, any side wall 520, and the bottom wall, or any combination thereof, and extending downward to terminate coplanar with the lower edge of each sidewall. Each support or reinforcing rib runs parallel to, perpendicular to, or at an acute angle to, any side wall.530

When installed, the seating member 510 may be horizontal or pitched downwards toward the prefabricated shower module 100. Additionally, the seating member 510 may include one or more sidewall or horizontal lip 550 at least 1 inch tall and at least ⅜ inches wide along at least one peripheral edge to allow for a standard-sized wallboard to rest on the lip 550.

The seating member and at least the upper portion 522 of the sidewall 520 adjacent to the sidewall 101, 102, 103, 104 of the shower module 100 have surfaces suitable for retaining tile, stone, or marble using an epoxy containing 100% resin solids or resin solids mixed with a solvent.

In one embodiment, the shower bench 500 may be constructed using similar polyurethane reaction injection molding techniques as described above in relation to the prefabricated shower module 100 and the modular curb 300. As in the case of the shower module 100 and the modular curb 300, the direction of flow of polymeric material should be unimpeded by the support ribs 530 during injection molding in order for the material to flow properly. Thus, the support ribs 530 should run parallel to, perpendicular to, or at an angle of 90° or less to the direction of flow of polymeric material. Additionally, to provide the proper support, the shower bench 500 should be molded from a polyurethane foam (which may also be fire-retardant) having a density of 12 pounds per cubic foot or greater.

Figure 31:
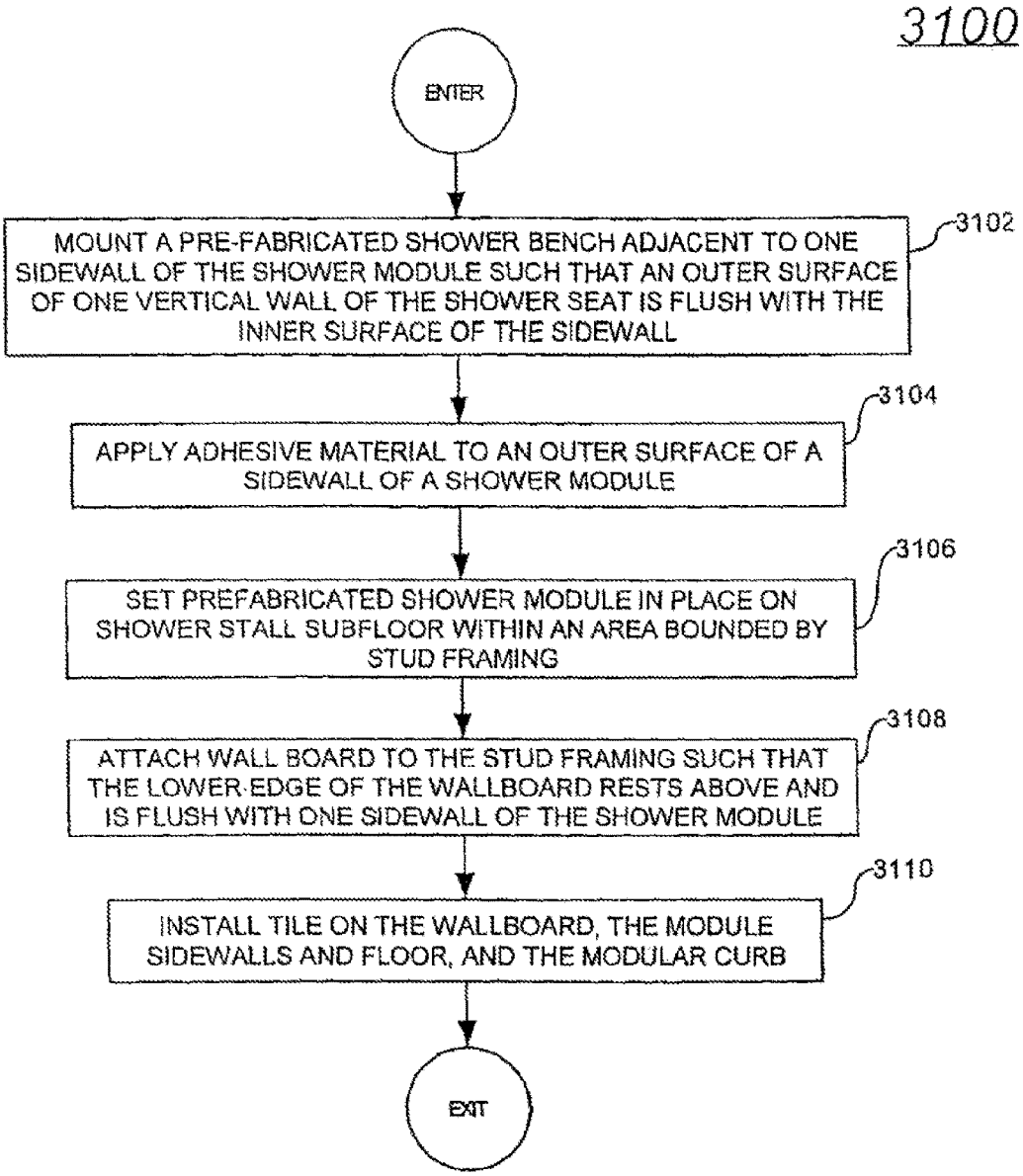
FIG. 31 is a logic flow diagram of various steps executed to implement a method for creating a tiled shower stall using a prefabricated leak-proof shower module and a prefabricated shower seat, in accordance with exemplary embodiments of the present invention.
Figure 32:
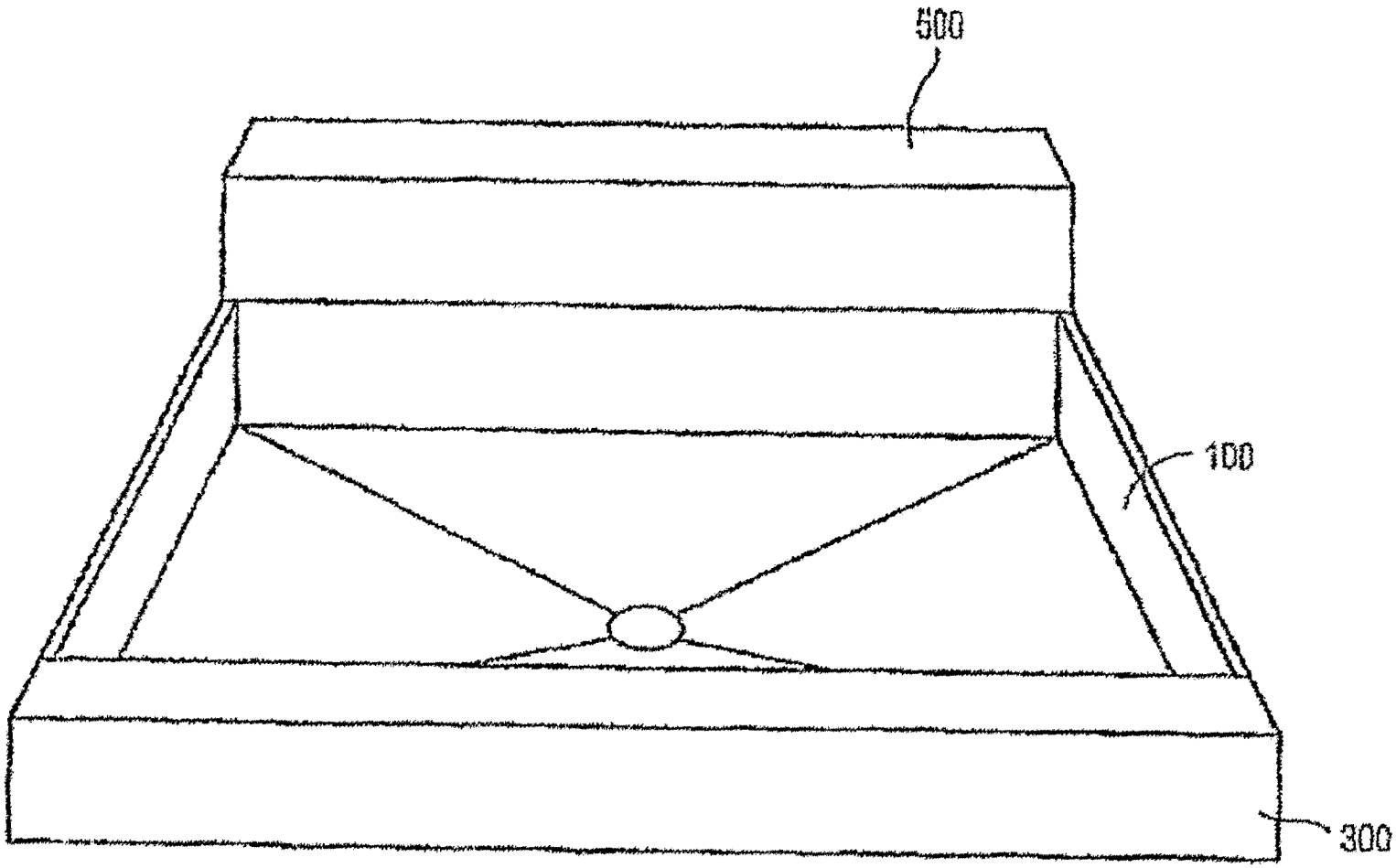
FIG. 32 is a front/top perspective view of a complete shower enclosure system constructed using a prefabricated shower module, a prefabricated modular curb, and a prefabricated shower bench, in accordance with exemplary embodiments of the present invention.
Figure 33:
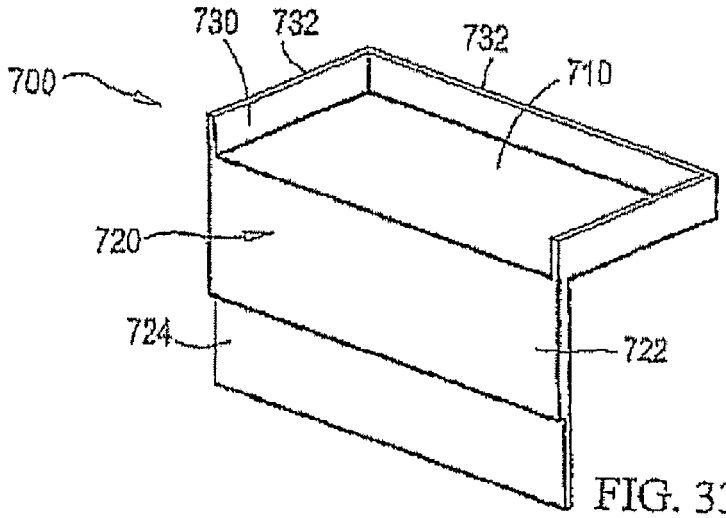
FIG. 33 is a front perspective view of a modified form of a prefabricated waterproof shower bench in accordance with this invention.
Figure 34:
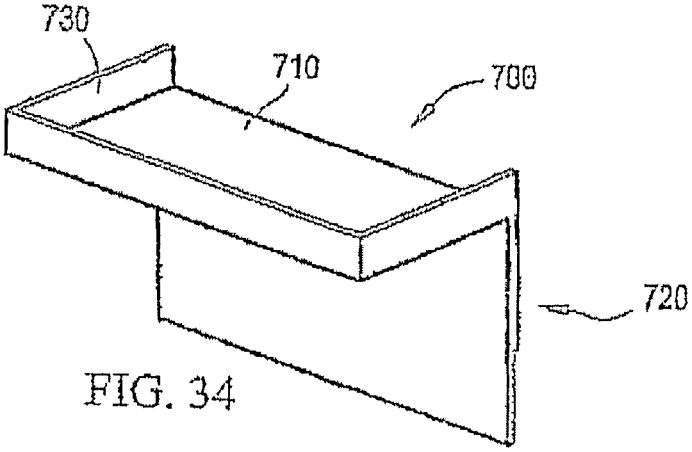
FIG. 34 is a rear perspective view of the shower bench of FIG. 33.

FIG. 31 illustrates an exemplary logic flow diagram 3100 executed by a shower enclosure installer to implement a method for constructing a tiled shower enclosure within an area bounded by a subfloor and stud framing using a prefabricated shower bench 500, a prefabricated shower module 100, and optionally, a prefabricated modular curb 300. FIG. 32 illustrates an exemplary finished shower enclosure created using embodiments of the prefabricated shower bench 500, the prefabricated shower module 100, and the prefabricated modular curb 300 as disclosed by the present invention. The installer begins by mounting (3102) a prefabricated shower bench 500, adjacent to the stud framing such that a bench sidewall 520 that has a lower portion 524 set back from an upper portion 522 is facing the area where the shower module 100 is to be installed. The shower bench may be fastened to the stud framing using traditional fastening techniques (e.g., braces, screws, nails, adhesives, etc.). Thus, when someone sits on the shower bench 500, the person's weight is supported by both the bench support ribs 540 and the stud framing and not distributed to the shower module 100.

Next, the installer applies (3104) a quantity of adhesive material on the subfloor within the area bounded by the stud framing and the shower bench 500, and sets (3106) the shower module 100 in place on the subfloor within the area bounded by the stud framing and the shower bench 500. The shower module 100 is positioned on the subfloor such that at least one module sidewall 101 is substantially adjacent to the stud framing, and a second module sidewall 102 rests underneath the lower portion 524 of the bench sidewall 520. The inner surface of the second module sidewall 102 is flush with an outer surface of the upper portion 522 of the bench sidewall 520, and the drain assembly is in fluid communication with the subfloor plumbing connection. The installer may also, optionally, attach a prefabricated modular curb 300 to a third sidewall 104 using techniques described, supra, in Section 3 or use a shower module 1400, 1500 with an integrated curb 140.

Finally, the installer attaches (3108) wallboard to the framing such that a lower edge of the wallboard rests above and is flush with the first module sidewall 101, and finishes the shower enclosure by installing (3110) tile, stone and/or marble on the wallboard, the module sidewalls 101, 102, 103, 104, the floor 110, the optional modular curb 300, and the prefabricated shower bench 500.

All features of the shower bench 500 and corresponding methods of installation described herein may be equally applied to creating a shower ledge simply by extending the height of the sidewalls 520.

Improved Shower Bench and Ledge.

A modified version of the leak-proof modular shower enclosure system shown in FIGS. 28-30 includes a shower bench, as illustrated in FIGS. 33-37. The combination of the bench with the shower module 100 offers significant improvement over prior art by attaching a leak-proof shower bench to a leak-proof shower module, at an attachment point that is also leak-proof, thereby maintaining the leak-proof integrity of the shower base system. In addition, shower benches and/or ledges having varied dimensions, shapes and features may be made in a single tool using a combination of removable inserts, which permit shower benches and/or shower ledges to be made in various heights, various lengths, and various depths by a single base tool so that the shower bench and/or ledge can be customized either through the manufacturing process or after fabrication by cutting the shower bench and/or the shower ledge to the desired dimensions.

The lower surface 513 of the seating member 510 defines a downwardly projecting seat area, as shown in FIG. 30. The upper surface 113 of the floor 110 defines an upwardly projecting floor area, which floor area ends at sidewall 101, as shown in FIG. 30. The upward projection of the floor area does not overlap with the downward projection of the lower surface 513 of the seating member 510 or the upward projection of the sidewall.

In one embodiment, a shower bench skin or shell 700 is designed for installation between a shower module 100 and a stud-framed wall (not shown) of the shower enclosure. The shower bench 700 may include a rectangular seating member 710 connected to an upper edge 712 of a sidewall 720. The length of the shower seat 700 is preferably equal to either the width or the length of the corresponding shower module 100 with which the shower bench 700 will be installed, although it will occur to those of skill in the art that the shower bench may be any desired length, width or height and still fall within the scope of the invention. The lower edge of each sidewall 720 terminates in a plane that either rests on the subfloor of the shower enclosure, or mates or aligns with an upper edge of a corresponding sidewall of module 100 (FIGS. 38-39, to be discussed supra).

In this particular embodiment, one sidewall 720 is divided into an upper portion 722 and a lower portion 724, wherein an area of the lower portion is recessed or set back from the upper portion 722 along the entire length of the shower bench 700. The lower portion 724 is taller than or equal to the height of a sidewall 101, 102, 103, 104 of the shower module 100, and is set back from the upper portion 722 an equal distance or a distance which is slightly greater than the thickness of the sidewall 101, 102, 103, 104 of the shower module 100. In this manner, when the shower bench 700 is installed adjacent to the sidewall 101, 102, 103, 104 of the shower module 100 the sidewall 101, 102, 103, 104 of the shower module 100 resides within the setback area, thereby preventing the weight of the shower bench 700 from resting on the sidewall 101, 102, 103, 104 of the shower module 100. Additionally, as shown in FIG. 30, the outer surface of the upper portion 722 of the shower bench sidewall 720 should be flush (i.e. coplanar) with the inner surface of the sidewall 101 so that when tile is installed to form the final shower enclosure, the transition between the shower module 100 and the shower bench 700 is unnoticeable.

Figure 38:
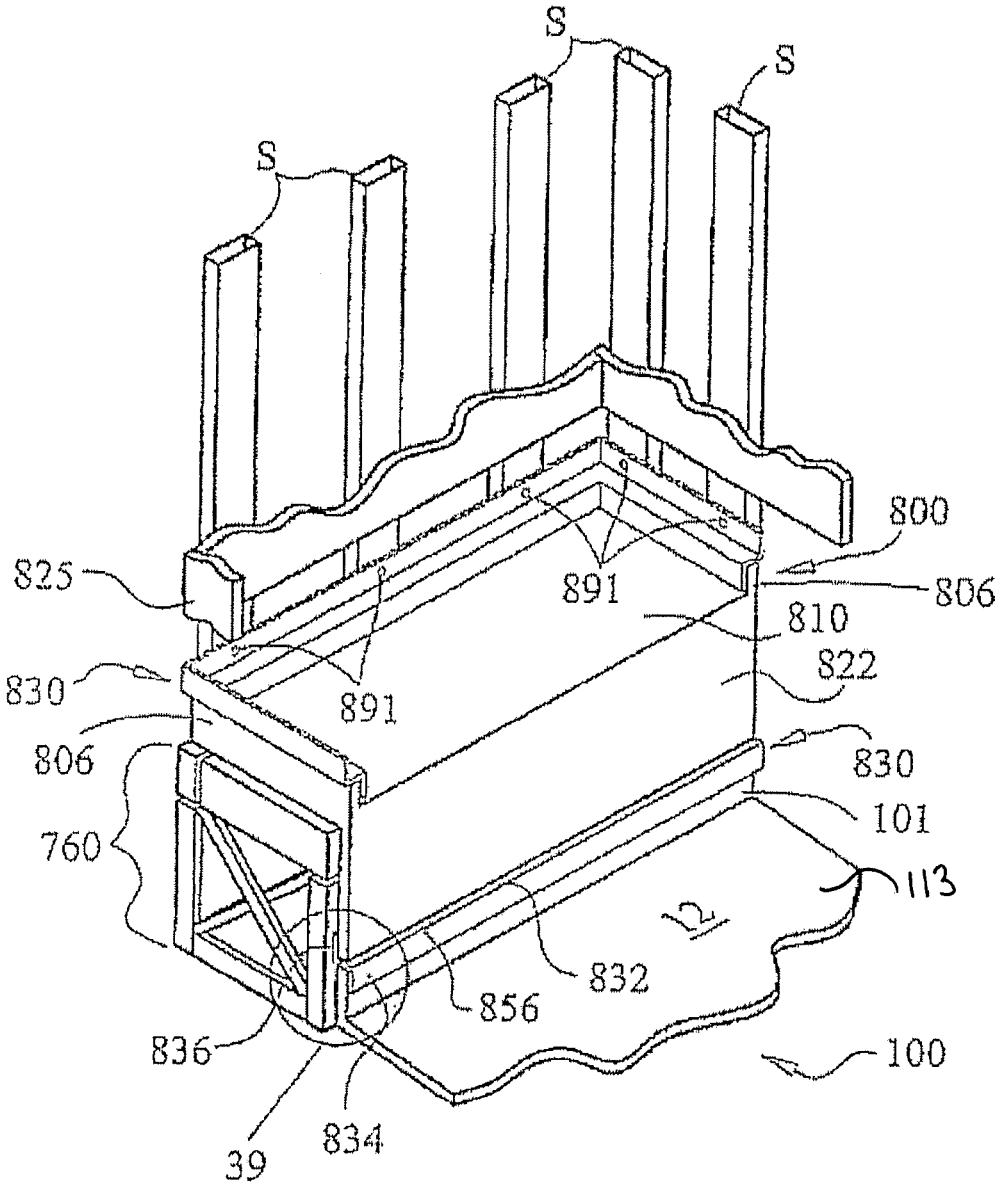
FIG. 38 is a partial perspective cutaway view of another embodiment of a shower bench in accordance with this invention.
Figure 39:
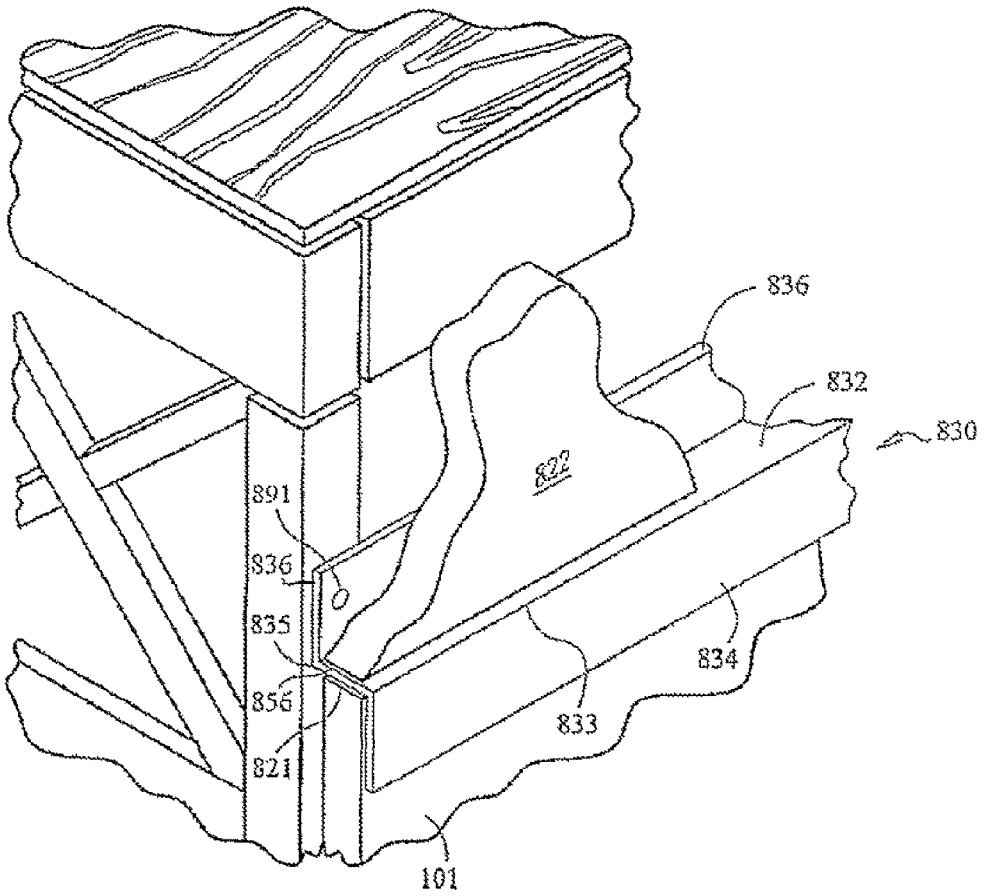
FIG. 39 is an enlarged view of the area of detail "A" shown in FIG. 38.

As shown in FIGS. 38 and 39, an alternative bench 800 is employed, wherein the recessed portion 724 of sidewall 720 is deleted, such that sidewall 101 of module 100 will end in an upper, substantially horizontal, edge 821 which will mate substantially in registry with a corresponding lower edge 856 of lower bench sidewall 822. Bench 800 includes a substantially horizontal seating member 810. In this embodiment, sidewall portion 822 terminates in the vicinity of upper edge 821 of module sidewall 101.

Seating area 810 of bench 800 is substantially horizontal, but preferably is slightly tilted off of the horizontal so that water will readily drain therefrom toward module 100. Bench 800 may also include integral sidewalls 806 extending substantially vertically upwardly from seating section 810. A support structure 760 should be used to support bench 800 in position in the shower enclosure. Support 760 may take the form of various frame members, ribs molded into bench 800 which extend from the underside of seating member 810 to the floor of the enclosure, or any other structure suitable to support bench 800 and any loads which are reasonably expected to be imposed thereon. The support 760 may, as stated above, be molded together with bench 800 during manufacture as an integral unit therewith, the support may be manufactured separately and installed in the shower enclosure prior to installation of the bench thereon, or the support 760 may be assembled in the field by construction workers or a home remodeler. Preferably, bench 800 is fastened to support 760 using suitable connection structure, such as fasteners, epoxy adhesive, polyurethane glue, or the like as will occur to those of skill in the art. Support 760 may take the form of the support members shown in FIG. 38, which may be 2×4 lumber, aluminum wall studs, or the like, and plywood sheeting as deemed necessary by the designer. Support 760 also forms a portion of the support for shower module 100. Frame 760

At the juncture of sidewall 822 and module sidewall 101, a waterproofing flashing 830 may be employed. The flashing 830 functions to prevent water which may be running down wallboard 825 or sidewall 822 from getting behind sidewall 820 or sidewall 822, causing water damage. Flashing 830 can take any of the forms of the flashing disclosed in my co-pending application filed on even date herewith, and the disclosure thereof is hereby incorporated by reference herein as though fully disclosed herein.

Installation of flashing 830 between sidewall 806 of shower bench 800 and wallboard 825 may be carried out in like manner to that described above. Obviously, instead of attaching flashing 830 to the bench support structure 760, flashing 830 is connected to the shower enclosure stud framing S after the bench is installed, and sheet rock 825 installed thereover Thinset and tiling is applied thereafter as will occur to those of skill in the art. The flashing should be sized in a thickness such that the tiling will create a smooth, coplanar, surface over the juncture of wallboard 825 with flashing 830.

In the preferred embodiment, flashing member 830 is preferably "z" shaped, comprised of a central flat horizontal member 832, a downwardly extending horizontal proximal leg member 834 connected at a proximal edge 833 of horizontal member 832, and an upwardly extending distal leg member 836 connected to a distal edge 835 of horizontal member 832. In its assembled form, flashing member 830 is attached (via fastener, adhesive or any suitable connecting structure 891) to support 760, or shower enclosure wall studframing members S, or any other suitable supporting device, prior to installation of the bench 800, but preferably before installation of module 100. Horizontal flashing member 832 is positioned on top and preferably, but not by way of limitation, in contact with upper module sidewall peripheral edge 821. Bench 800 is then installed, and thinset or other tile adhesive material applied there over, and tiles or other finishing material placed there over.

As can be appreciated, the thickness of flashing 830 should be sized so as not to have any appreciable affect on the thinset layer so that tiles can be placed across the intersection of wallboard 825 with module sidewall 101 without any undulation.

Figure 35:
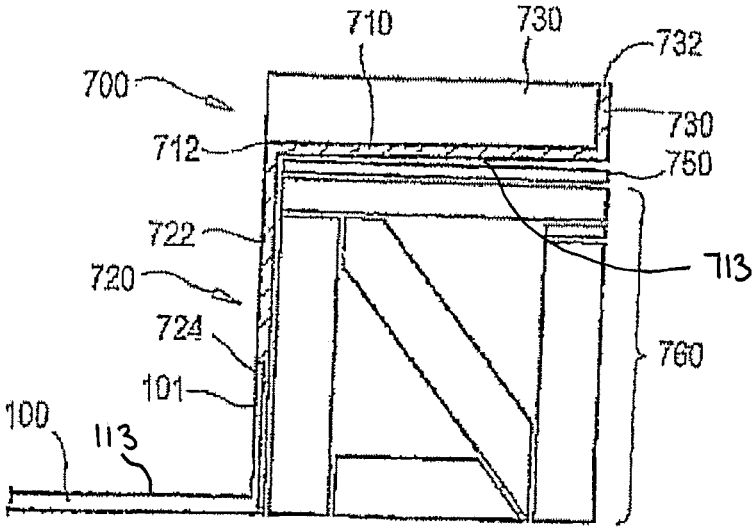
FIG. 35 is a side elevational cross-sectional view of the shower bench of FIG. 33, taken along lines 35-35 of FIG. 36, supported by a support structure.
Figure 36:
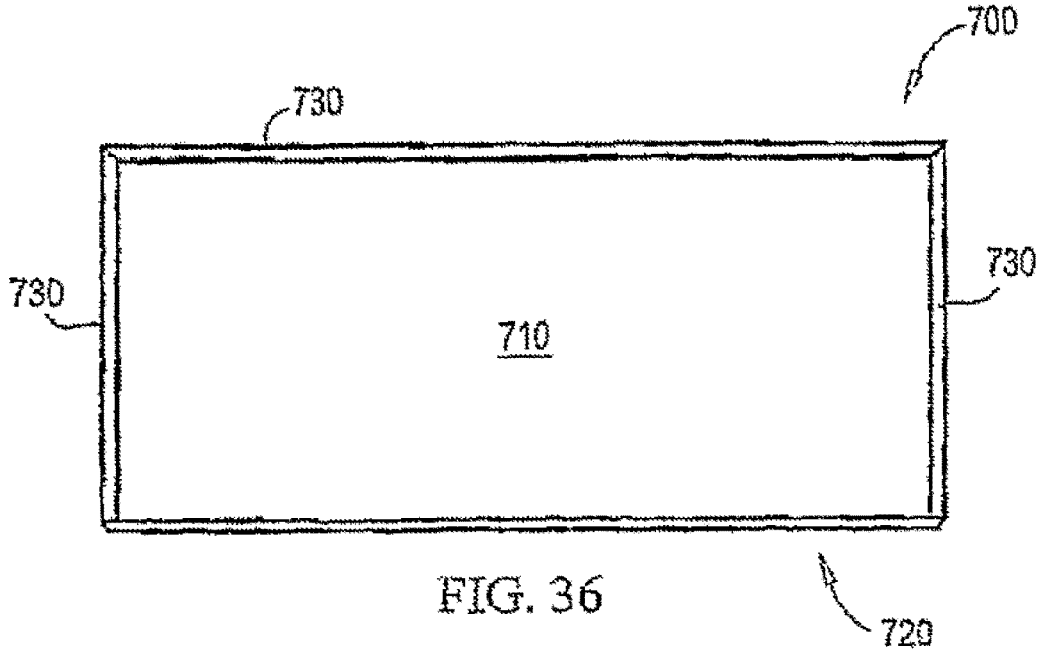
FIG. 36 is a front elevational view of the shower bench of FIG. 33.
Figure 37:
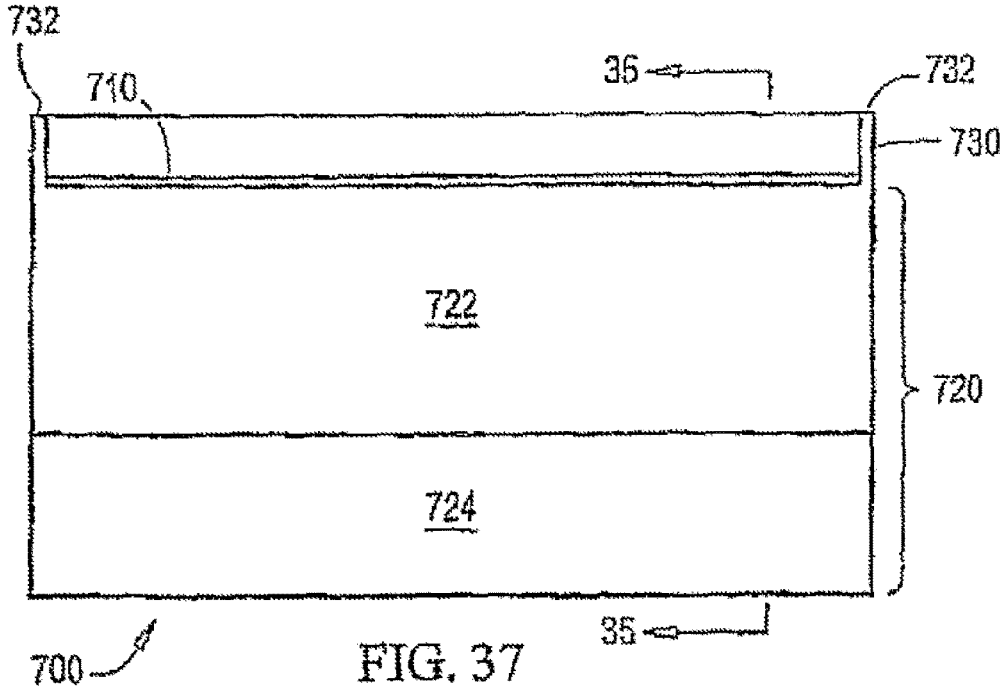
FIG. 37 is a top plan view of the shower bench of FIG. 33.

The lower surface 713 of the seating member 710, in combination with the support structure 760, defines a downwardly projecting seat area, similar to FIG. 30. The upper surface 113 of the floor 100 defines an upwardly projecting floor area, which extends upward independent of the sidewall 101, such that the upwardly projecting floor area does not overlap with the downwardly projecting seat area or the upward projection of the sidewall, as shown in FIG. 35.

Also, the height of upstanding leg 836 of flashing 830 can be any suitable height, and is preferably in the range of ¼" to 6". The width of horizontal member 832 should be sized so as to substantially coincide with the thickness of module sidewall 101 and/or wallboard 825. The height of depending leg 834 can be any height, e.g. 1/16 inch.

The function of flashing 830 is to prohibit water which has intruded behind tiles into and/or behind the thinset layer from traveling behind wallboard 825 or module sidewall 101. This occurs due to the vertical member 836 acting as a barrier to water which has seeped into any gap between peripheral edge 826 of wallboard 825 resulting from the downflow of water due to gravity. Any such water will be constrained to the space 845 between wallboard 825 and vertical flashing member 836.

In this particular embodiment, a lower surface of the seating member 810, in combination with the support structure 760, defines a downwardly projecting seat area, similar to FIG. 30. The upper surface 113 of the floor 100 defines an upwardly projecting floor area, which extends upward independent of the sidewall 101, such that the upwardly projecting floor area does not overlap with the downwardly projecting seat area or the upward projection of the sidewall, as shown in FIG. 38.

Design and Construction of Shower Bath Enclosures

The process for designing and building a shower or bath enclosure in accordance with this invention includes installing wall stud framing members to generally frame out the space within which the shower enclosure will reside, installing a frame 760 upon which bench 800 will be placed, the frame being placed adjacent to wall studs S and, preferably, being attached thereto in any suitable manner which will occur to those of skill in the art (such as by adhering frame 760 to the sub-floor using mortar or the like), installing waterproof shower or bath module 12 on the subfloor, preferably in a mortar or other material which will stabilize and fix the module 12 in place, the sidewall 101 of module 12 being placed adjacent to frame 760, attaching flashing 830 to frame 760 such that lower leg 834 of flashing 830 hangs down over sidewall 101 of module 12, placing bench 800 on frame 760 such that lower edge 856 of bench sidewall 822 is placed substantially in registry with top edge 821 of module sidewall 101 with horizontal flashing portion 832 sandwiched therebetween, attaching upper bench flashing 830 to wall studs S, for example by using the vertical sidewall 806 of bench 800, installing wallboard 825 such that the lower edge of wallboard 825 is placed substantially in registry with a corresponding upper edge of sidewall 806, and tiling over or otherwise finishing the entire surface of module 12, bench 800 and wallboard 825 to complete a shower or bath enclosure. It should be noted that the order of the foregoing steps may be modified at the discretion of the installer, the particular order recited above being but a mere example of an installation process.

A bench shell 800 in accordance with this invention may be installed adjacent to one or more panels of glass to act as a shower or bath wall or partition, such that a bottom edge of the glass sits on, and is supported by, the bench seat 710, 810, or on one or more of sidewalls 730, 806.

As described above, the present invention encompasses a modular system for creating a tiled shower or bath enclosure including one or more component pieces (e.g., a prefabricated shower module with or without an integrated curb, a prefabricated modular curb, a prefabricated shower bench, and a prefabricated ledge), and methods of designing and installing the relative positioning of the associated component pieces, in a shower enclosure space which does not conform precisely to the dimensions of the component pieces (e.g. shower module and bench) used to create the finished shower or bath. With this invention, designers will be able to use space in a floor plan that would otherwise have been unusable, while at the same time having the flexibility of specifying standard-sized components for the shower or bath. Moreover, manufacturers will be able to satisfy a demand for a greater variety of prefabricated shower or bath components without the need to invest in the manufacture of a greater variety of products. Additionally, the system offers tremendous flexibility in employing numerous combinations of component pieces, thereby providing many more options for creating modular shower or bath enclosures. The system may be installed in the field in a fraction of the time required using traditional prior art methods, which greatly assists installers and contractors when building multiple enclosures (e.g., newly constructed condominiums, apartment buildings, hotels, dormitories, prisons, pre-manufactured housing, etc.).

Reference hereinafter to "shower" is intended to encompass "shower or bath." The need being addressed can best be understood by viewing FIGS. 40A, 40B, 41A, 41B, 42A and 42B and assuming a shower enclosure space A having a length $D_1$ and a width $D_2$ within which the shower enclosure components, whatever they may be (e.g. shower module, shower bench, shower soap/shampoo ledge, etc.), must fit. It is to be understood, however, that the enclosure space A may be of any form, whether square, rectangular, other polygon, circular, free-form, etc. The enclosure space A, the footprint of which will typically be surrounded by wall studs S and the right edge of curb 140 of shower module 100 for a rectangular-shaped space A, can be seen in FIGS. 40B, 41B and 42B. Often, the architect, engineer or designer designing an overall floor plan or portion thereof will be left with a predetermined amount of space, i.e. the footprint hereinabove described, within which to fit the shower enclosure components. Those components will typically consist of a shower module 100, a modular prefabricated waterproof shower bench 1130, drywall or other wall-forming substrate 1155, and finishing tile or other surface-finishing material 1160.

As best seen in FIGS. 40A, 40B, 41A, 41B, 42A, 42B, and 43, enclosure space A, which is the area in which a shower or bath is to be constructed, is defined by a length $D_1$ and width $D_2$. IN the embodiment shown in FIGS. 40A-42B, the components which are included in the shower or bath construction will include a shower bench 1130, which has an overall length $D_4$, and a shower module 100, which has an overall length $D_5$. In addition, when module 100 is placed within enclosure A such that the right edge of curb 140 (i.e. shower module sidewall 101) is at the rightmost edge of enclosure A, as is the case in FIGS. 40A-42B, the distance remaining between the leftmost sidewall 103 of module 100 and leftmost wall studs S is $D_3$. In the preferred embodiment, shown in FIGS. 40A and 40B, the length $D_5$ of module 100 combined with the length $D_3$ of bench 130 will be the same as length $D_1$, such that:

$$D_3+D_5=D_1$$

where $D_3=D_4$.

In other embodiments, that is where $D_3$ does not equal $D_4$, a gap between the left edge of sidewall 103 and leftmost wall studs S space is created, which must be covered to create a finished shower or both enclosure. In that event, either the bench seat 1132 must be reduced in size so that $D_3$ will be made equal to $D_4$, or the bench 1130 must be overlapped with module 100, examples of which are shown in FIGS. 41A-B and 42A-B. Alternatively, the designer could specify that the length of seat portion 1132 of bench 1130 can be manufactured to coincide with the length $D_3$ of the space between left most side wall 103 and left most wall studs S. The latter configuration would be most achievable in the case of the original manufacture or renovation of a multi-unit housing/hotel complex, where the shower enclosure length $D_1$ is constant for a large number of condo/apartment/hotel units.

The length $D_4$ of bench seat 1132 can be set during the manufacturing process to conform to the dimension $D_3$ needed to fill the space remaining between sidewall 103 and wall studs S much more simply than to custom make a shower floor module 100, as the molds used for each shower module vary significantly, and it is simply easier to modify tooling for a shower bench such as bench 1130 than it is to modify the tooling for a shower floor module. Therefore, it is preferred to manufacture or select a pre-existing bench having a depth equal to $D_3$. In this way, the standard depths $D_5$ in which shower modules are manufactured can be retained, thereby greatly reducing what would otherwise be the cost of custom manufacturing shower modules to fit the nearly infinite number of possible shower enclosure space depths $D_1$ while simultaneously increasing the flexibility that the designer has to maximize the utilization of the overall floorplan space in which the shower is to be constructed.

Figure 40A:
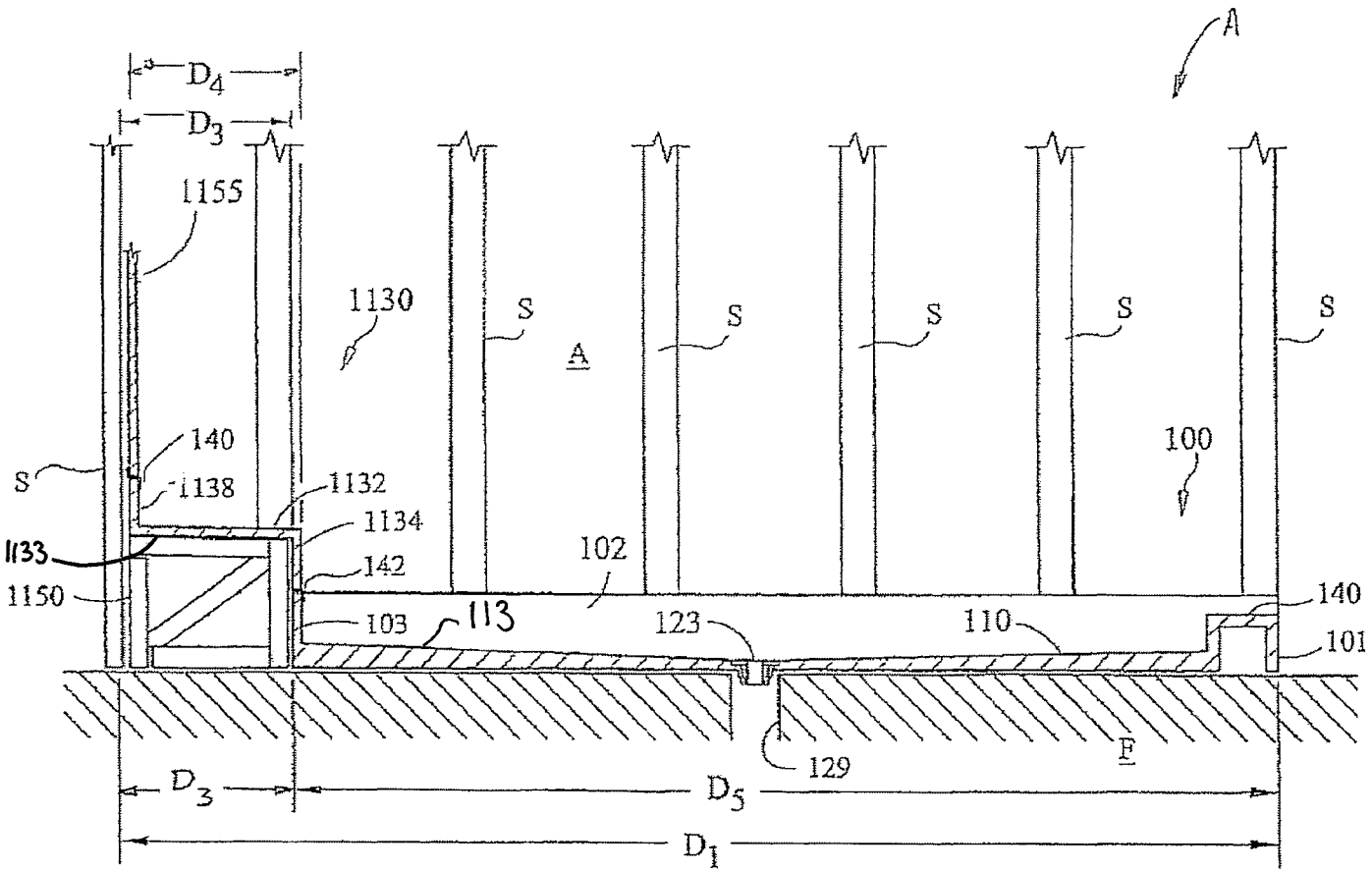
FIG. 40A is a cross sectional elevational view of a shower enclosure space showing a water proof prefabricated shower module and a bench installed therein, where the bench leg wall is positioned in registry with a sidewall of the shower module.
Figure 40B:
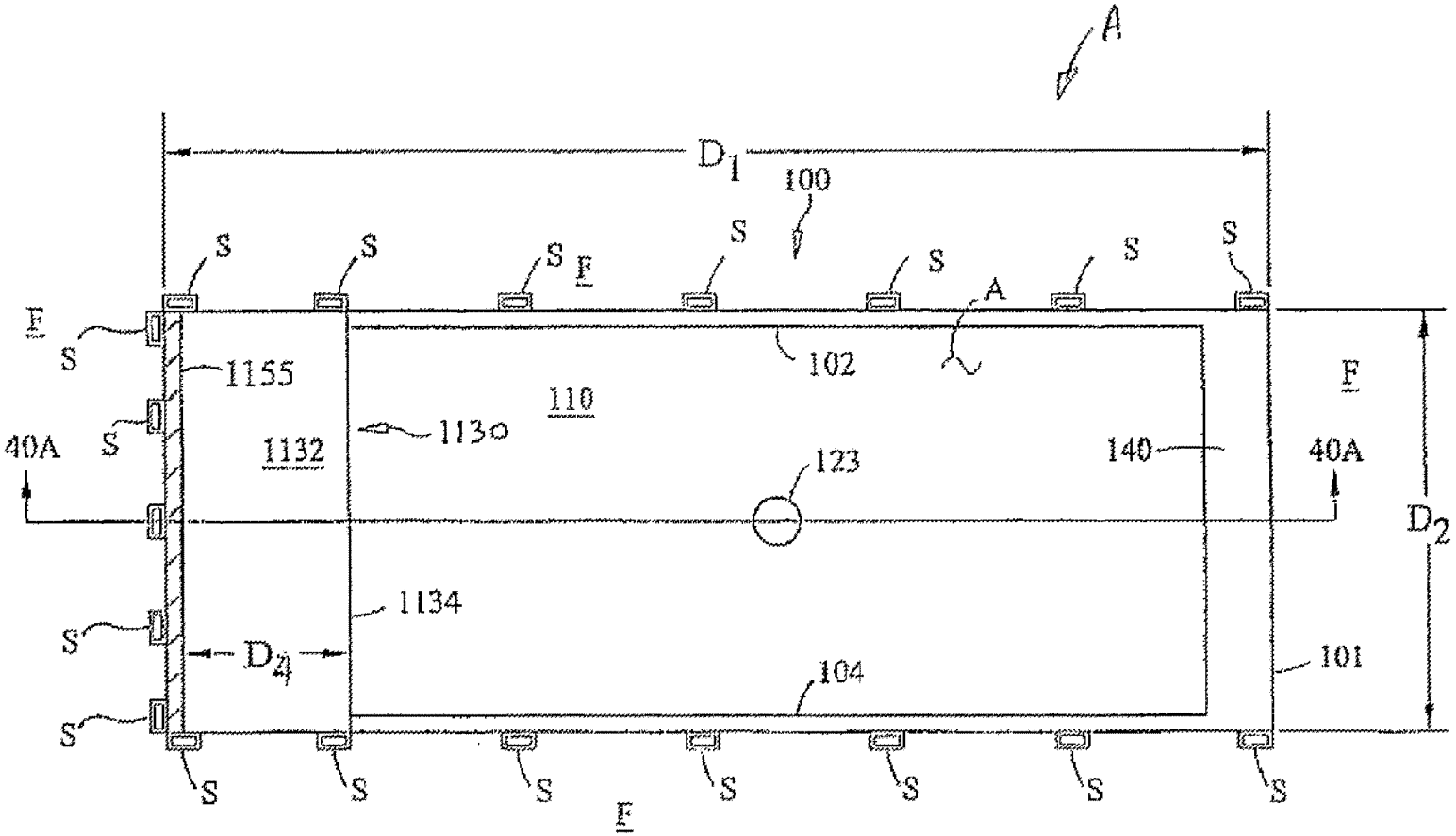
FIG. 40B is a top plan view of the shower enclosure space shown in FIG. 40A.

Referring now to FIGS. 40A and 40B, there is shown a first, and preferred, installation configuration of the invention, wherein the dimensions $D_1$ and $D_2$ of the enclosure A create a footprint, i.e. surface area/shape, on the subfloor F that is larger than the area covered by shower module 100 when viewed from above, as shown in FIGS. 40A-B. The enclosure A is bounded below by the bathroom subfloor F and on the sides by wall studs S or other framing structure, although at least a portion of one side of the enclosure space will be bounded by the shower opening or threshold, such as curb 140, through/over which the person using the shower will enter the enclosure. Typically, the threshold of shower module 100 will be curbed at 140, although that area of the module 100 may be barrier-free, such that it will be substantially coplanar with the shower subfloor F, be ramped, define a slightly raised water barrier, or any other configuration defining a threshold between the shower and the adjacent bathroom.

Flashing 140, 142 is fully disclosed in my related application entitled "Waterproof Juncture" which is the subject of U.S. patent application Ser. No. 12/435,959, filed on May 5, 2009, disclosure of which is incorporated by reference as though fully set forth therein. Preferably but not by way of limitation, flashing 140, 142 may be formed as a Z-shaped member having a central, generally horizontally disposed, central member 1032, a downwardly depending front member 1034 which ends in a lower edge 1035, and an upwardly extending rear member 1038 ending in and upper edge 1039.

In the above described circumstance, since the module 100 is not large enough to fill the entire surface area within the enclosure A, that is, the length $D_1$ of the enclosure A is larger than the length $D_5$ of the shower module 100 by a distance $D_3$, something must be added to occupy the open space, i.e. the space between the sidewall 103 of module 100 at the leftmost end of module 100 shown in FIG. 40B and the wall studs S on the left side of FIGS. 40A and 40B. To complete the construction of the shower, therefore, a shower component such as a waterproof bench 1130 is added. Such a bench is preferably of the prefabricated variety, but may also be constructed on site. A prefabricated bench which is suitable for use with the instant invention comprised of a substantially horizontal seat member 1132, a generally vertically extending leg wall section 1134, and a generally vertically upwardly extending back rest or splashwall section 1138. As is the case with the configuration shown in FIG. 40A, leg wall 1134 extends downwardly such that it can be placed in registry with an upper edge of shower module sidewall 103 when bench 1130 is placed upon bench support apparatus 1150. Support apparatus 1150 may take any form, or be made of any material, suitable under the circumstances to support bench 1130 in association with wall studs S and module sidewall 103. Such support apparatus 1150 may even be formed integrally with, or attached to, bench 1130. Preferably, but not by way of limitation, support 1150 is placed in abutting relationship with shower module 100 such that sidewall 103 is adjacent thereto and can be secured thereto by adhesive or other mechanical fastening means. Other suitable prefabricated benches are disclosed in my co-pending application Ser. No. 12/463,803 entitled "Improved Method of Manufacturing and Installation of Prefabricated Shower Benches and Associated Shower Benches", filed May 11, 2009, the disclosure of which is incorporated by reference herein as the fully set forth herein.

Waterproofing, such as flashing 140, 142, may be employed at the juncture of wallboard 1155 with splashwall 1138, and between the lower terminal end of legwall 1134 and upper end of sidewall 103, respectively. Backrest/splashwall 1138 of bench 1130 is adapted to be placed in registry with drywall 1155 or other wall-forming substrate.

Figure 41A:
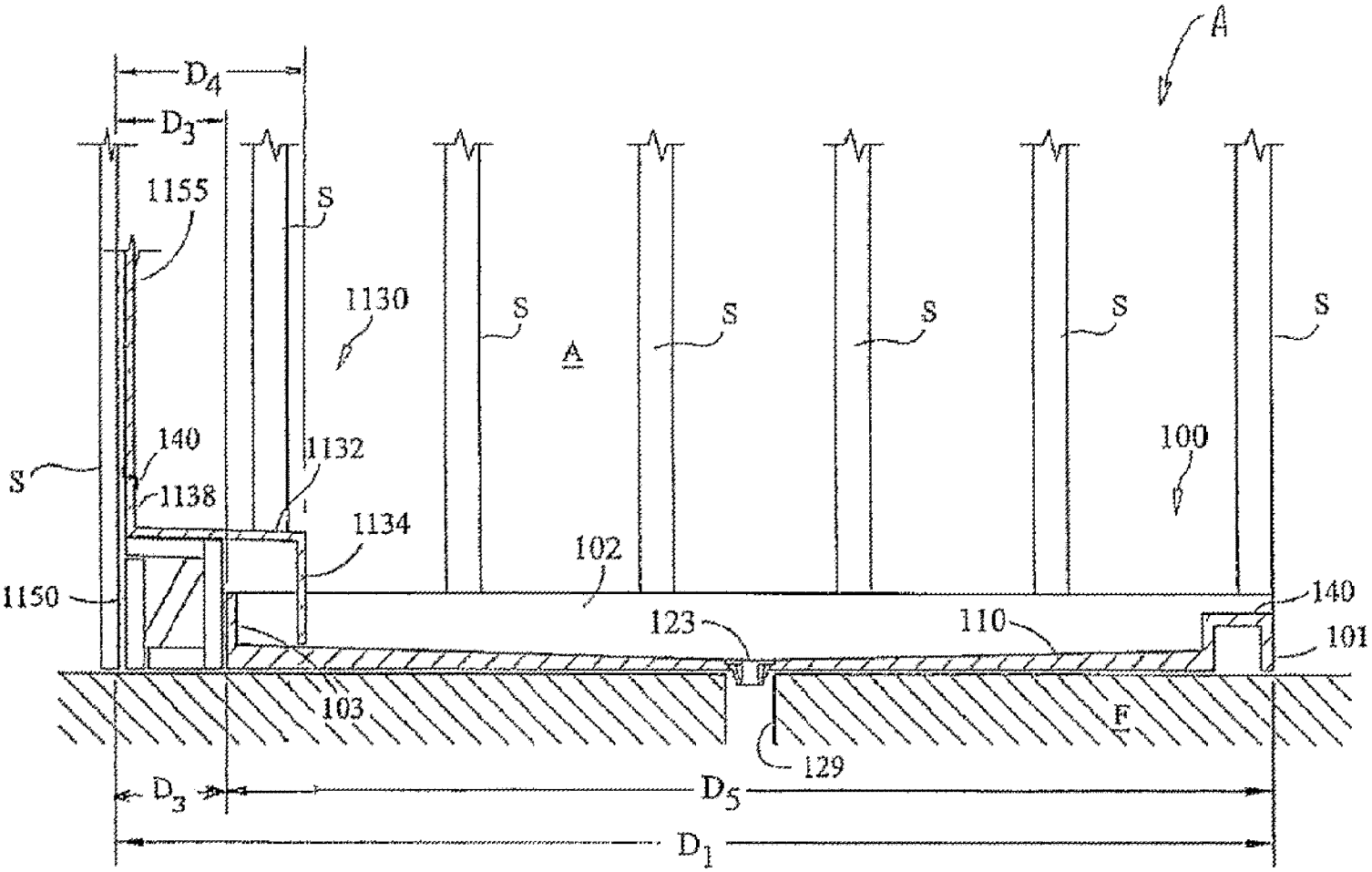
FIG. 41A is cross sectional elevational view of a slightly smaller shower enclosure than the shower enclosure shown in FIG. 40, such that the shower bench leg wall is located inside the sidewall of the shower module.
Figure 41B:
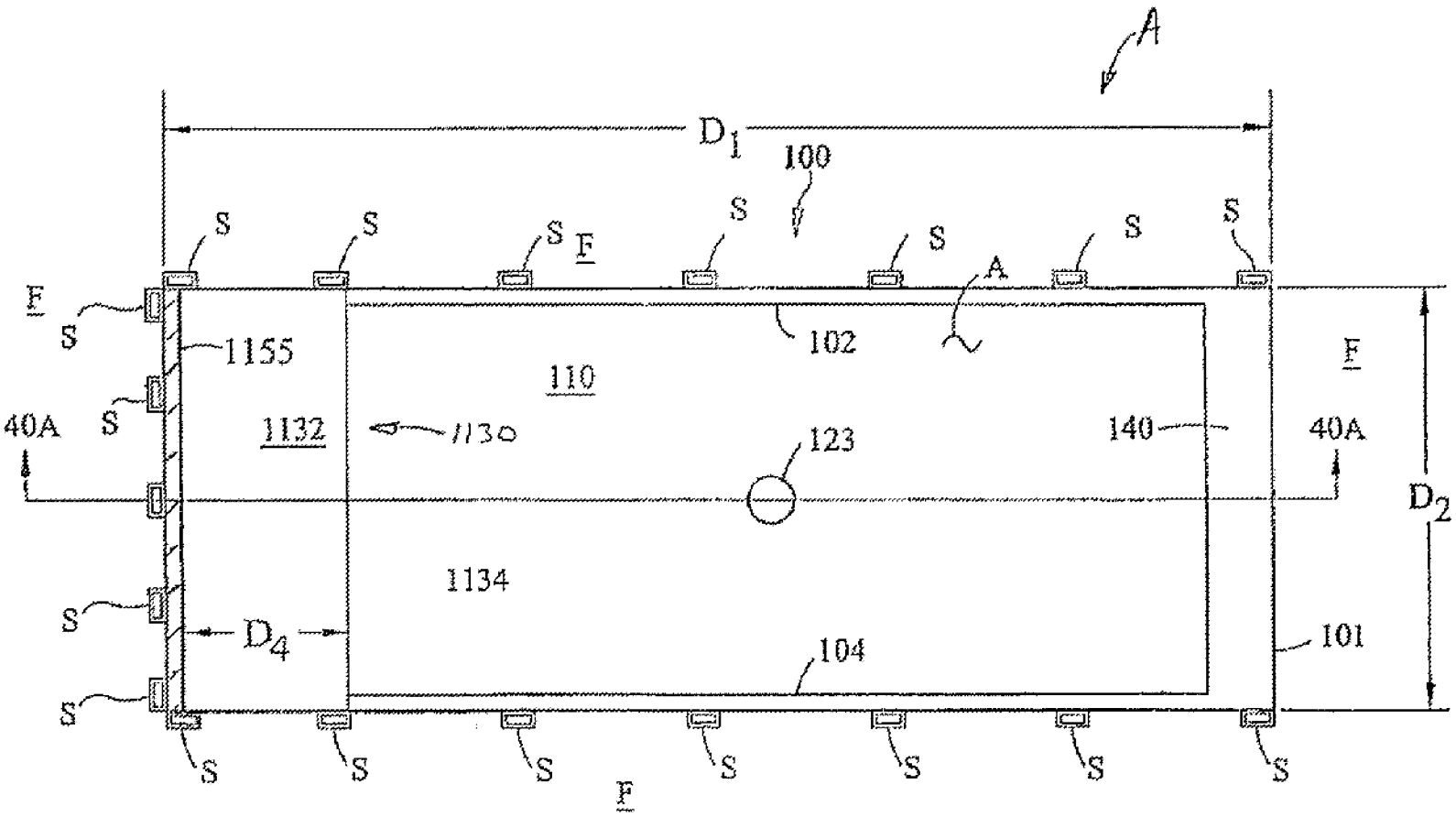
FIG. 41B is a top plan view of the shower enclosure space shown in FIG. 41A.

As best shown in FIGS. 41A and 41B, there may be instances where a designer specifies a standard shower module 100 and a standard bench 1130, such that the combined lengths $D_4$ of the bench and $D_5$ of the shower module exceed the length $D_1$ of the shower space A (i.e. length $D_3$ and $D_4$ are different). In this case, legwall 1134 will not be placed in registry with sidewall 103, but will, instead, be positioned somewhere between sidewall 103 and drain 123. In this event, it is desirable, but not required, to raise the level of the module floor 110 in the area 1158 residing between sidewall 103 and legwall 1134 to be of a height at least slightly greater than the top of the floor tiles 1160. In this way, any water which may intrude behind legwall 1134 will tend to flow toward drain 123.

Figure 42A:
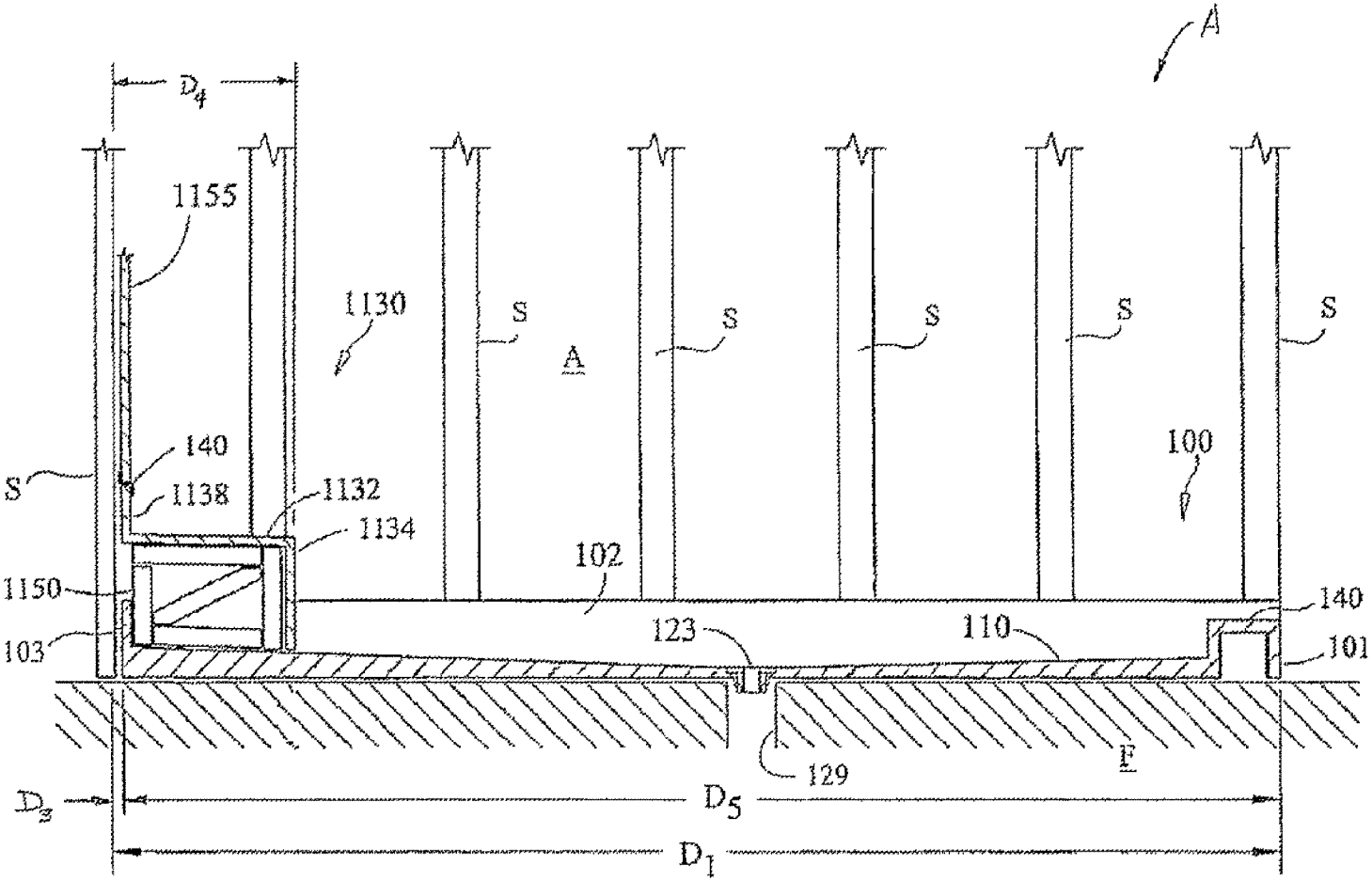
FIG. 42A is a cross sectional view of a shower enclosure wherein the shower bench is located entirely within the sidewall of the shower module.
Figure 42B:
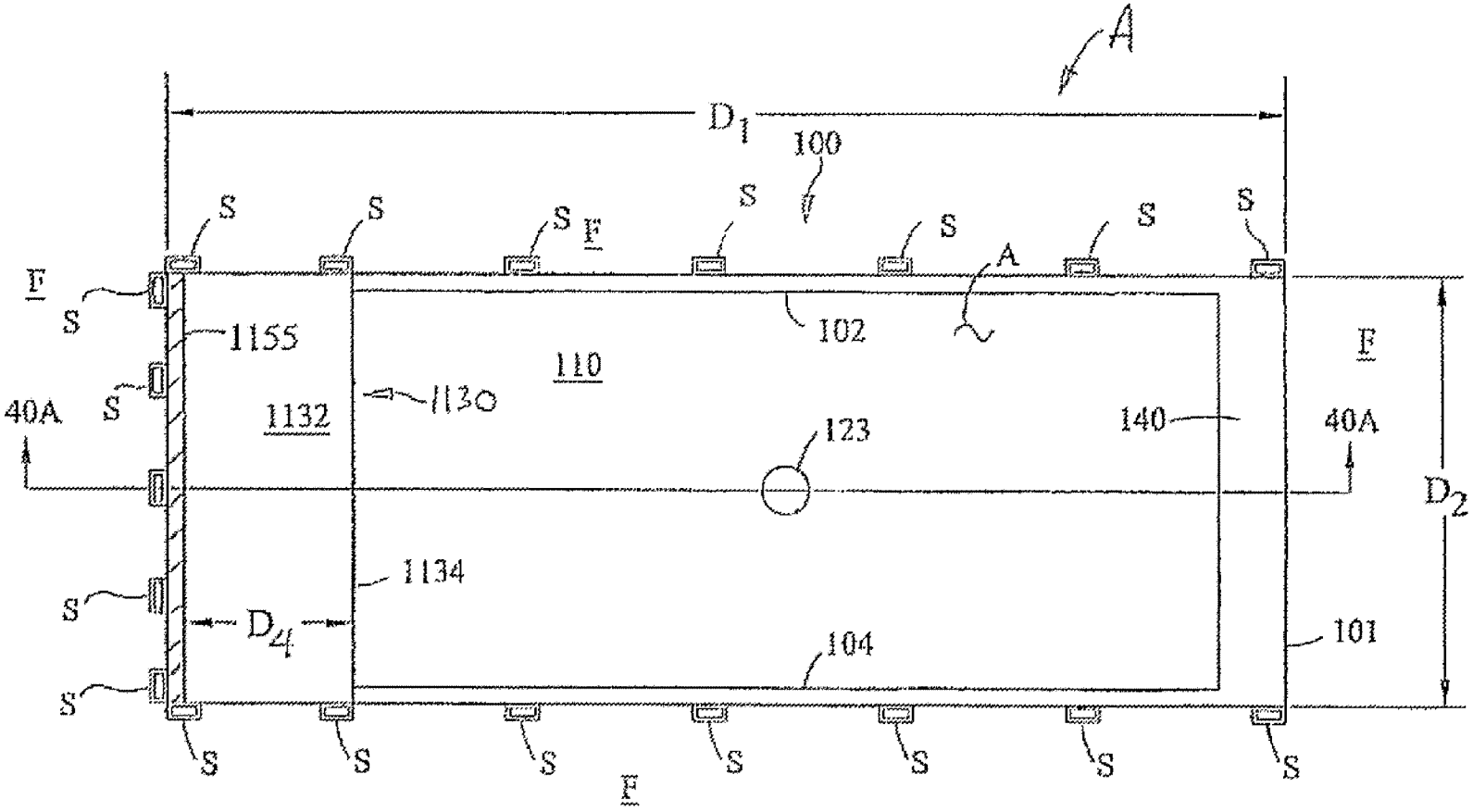
FIG. 42B is a top plan view of the shower enclosure space shown in FIG. 42A
Figure 44:
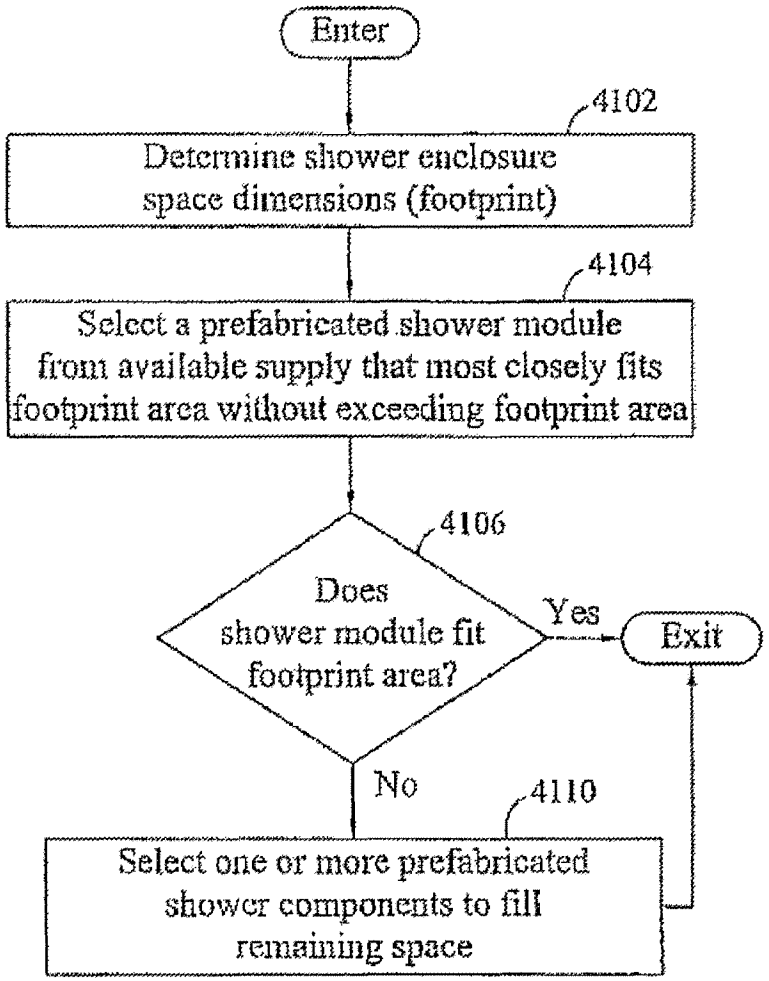
FIG. 44 is a logic flow diagram of various steps executed to implement a method for creating a shower enclosure.
Figure 43:
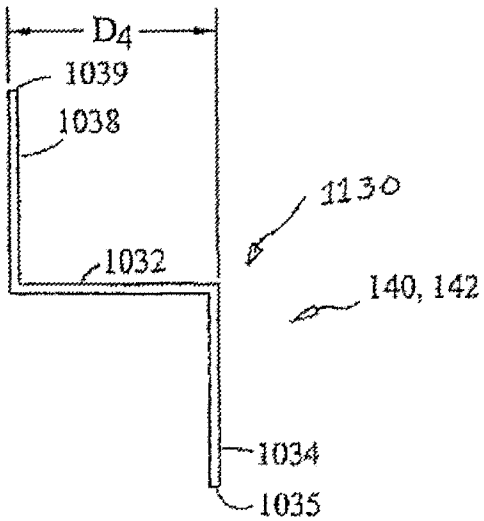
FIG. 43 is a left side elevational view of an example of a flashing/waterproofing article which may be employed with this invention.

Another configuration is shown in FIGS. 42A and 42B, wherein distance D3 is nominal enough such that bench support 1150 can only fit within the confines of floor module 100. Bench support 1150, in this case, may be placed and/or affixed to floor 110 of floor module 100 and bench 1130 placed or connected thereon in the manner described herein or as will occur to those of skill in the art. Legwall 1134 may be manufactured to extend to floor 110, or may be lengthened in the field by the addition of drywall or other planar matter to simulate an extension to legwall 1134.

A preferred implementation of the invention includes the following steps: determine and/or receive shower enclosure space dimensions (i.e. the dimensions of footprint A); (steps 4102); select and/or receive a shower module from the available supply of shower modules that most closely fits the footprint A without exceeding the size of the footprint (step 4104); determine if the shower module fits the footprint (such that there is no space or gap remaining between wall studs S and any one of sidewalls 102, 103 or 104) (step 4106); if the shower module does not fit (i.e. substantially fill space A), select one or more prefabricated shower components to fill the space(s) (step 4110). Such shower components, as stated previously, may be in the form of one or more shower benches, shower ledges or the like. The step 4102 of receiving shower enclosure space dimensions corresponding to the footprint A can be carried out by the designer, architect, engineer, etc. being given those dimensions or that person actively seeking out those dimensions or otherwise ascertaining them. The step 4104 of selecting a prefabricated shower module can be carried out by looking to any suppler of prefabricated shower modules. The step 4110 of selecting one or more prefabricated shower components to fill the remaining space, if any, in the enclosure A can be fulfilled in any number of ways. For example, the designer, architect or engineer may specify a predetermined size of shower bench which is readily available on the market from any number of suppliers if more than one, or the designer may specify a particular dimension or dimensions for such a shower bench to be manufactured in.

As can be seen in FIGS. 42A and 42B, bench 1130 may be placed entirely within the confines of shower module sidewalls 101, 102, 103 and 104, especially where the sidewall 103 rests against or near the leftmost wall studs S. In such an embodiment, support structure 1150 will be placed/built upon floor 110 of shower module 100, where sidewall 103 of shower module 100 is placed near wall studs S. As in the embodiment shown in FIG. 41A, the floor area 1158 of module floor 110 between sidewall 103 and legwall 1134 should, preferably, be raised so as to prevent the accumulation of water thereon.

It is to be further understood that sidewalls 102 and 104 of module 100 may also not abut studs when the module is placed within the enclosure, such that the space there between must also be filled with a shower component such as a bench or ledge in the manner disclosed herein.

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention.

In this particular configuration, the lower surface 1133 of the horizontal seating member 1132, in combination with the support apparatus 1150, defines a downwardly projecting seat area, similar to FIG. 30. The upper surface 113 of the module floor 110 defines an upwardly projecting floor area, which extends upward independent of the sidewall 103, such that the upwardly projecting floor area does not overlap with the downwardly projecting seat area or the upward projection of the sidewall, as shown in FIG. 40A. This abutting relationship with the shower module 100 optimizes the enclosure A.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made while this application is pending and all equivalents of those claims as issued.

What is claimed is:

1. A method for transforming an enclosure space into a shower or bath enclosure space, the enclosure space defined by a boundary, the method comprising the steps of:

determining proposed dimensions of the enclosure space;

selecting a floor module, said floor module comprising a floor and at least one sidewall extending upwardly therefrom, said module defining an outer peripheral edge and being adapted to be placed within the enclosure space wherein the outer peripheral edge of the floor module defines an area that is smaller than an area defined by the boundary of the enclosure space;

the floor including an upper floor surface which terminates at said sidewall and which defines an upwardly projecting floor area selecting a bench to occupy at least a portion of an open space(s) between the outer peripheral edge of the floor module and the boundary of the enclosure space;

said bench comprising a seat and a legwall extending downwardly from the seat, the legwall defining a lower legwall edge;

the seat defining an upper surface and a lower surface, said lower surface defining a downwardly projecting seat area;

said sidewall defining an upper sidewall edge; and installing the bench in such a way that the lower legwall edge rests substantially in registry with the upper sidewall edge;

wherein at least one surface of the legwall and at least one surface of the sidewall are substantially co-planar; and wherein the upwardly projecting floor area does not overlap with the downwardly projecting seat area.

2. The method of claim 1, further comprising:

attaching wallboard in the enclosure space such that a lower edge of the wallboard rests above and is in substantially in registry with an upper peripheral edge of a sidewall of the bench.

3. The method of claim 2, further comprising:

installing at least one of tile, stone and marble on at least one of the wallboard, the module, and the shower bench.

4. A shower or bath enclosure installed in an enclosure space, the enclosure space defined by a boundary, comprising:

a floor module, said floor module comprising a floor and at least one sidewall extending upwardly therefrom, the floor including an upper floor surface which terminates at said sidewall and which defines an upwardly projecting floor area, said sidewall defining an upper sidewall edge, said module defining an outer peripheral edge and being sized and shaped to define an area that is smaller than an area defined by the boundary of the enclosure space, thereby leaving an open area between the outer peripheral edge of the module and the boundary of the space; and a bench which occupies at least a portion of the open area;

said bench comprising a seat and a legwall extending downwardly from the seat, the legwall defining a lower legwall edge, the seat defining an upper surface and a lower surface, said lower surface defining a downwardly projecting seat area;

the lower legwall edge resting substantially in registry with the upper sidewall edge;

wherein at least one surface of the legwall and at least one surface of the sidewall are substantially co-planar and wherein the upwardly projecting floor area does not overlap with the downwardly projecting seat area.

5. The enclosure of claim 4, further comprising:

a bench backrest extending upwardly from the seat, the backrest defining an upper backrest edge.

6. The enclosure of claim 5, further comprising:

a wallboard attached to studs within the enclosure space such that a lower edge of at least a portion of the wallboard rests substantially in registry with the upper backrest edge.

7. The enclosure of claim 6, wherein at least one of tile, stone and marble is attached to one or more of the wallboard, the module, and the shower bench.

8. A method of installing a tiled shower within an enclosure space bounded by a subfloor and wall studs, the space defined by a boundary, the method including the steps of:

placing a shower module in the enclosure space, said shower module comprising a floor and at least one sidewall extending upwardly therefrom, the floor including an upper floor surface which terminates at said sidewall and which defines an upwardly projecting floor area, said sidewall defining an upper sidewall edge, said module defining an outer peripheral edge, an area defined by said module being smaller in at least one dimension than an area defined by the boundary, thereby leaving open area between the outer peripheral edge of the module and the boundary of the space;

placing a bench in the enclosure space so that the shower bench covers at least a portion of the open area between the outer peripheral edge of the shower module and the boundary of the enclosure space;

said bench comprising a seat and a legwall extending downwardly from the seat, the seat defining an upper surface and a lower surface, said lower surface defining a downwardly projecting seat area, the legwall defining a lower legwall edge; and installing the bench within the enclosure such that the lower legwall edge rests substantially in registry with the upper sidewall edge;

wherein at least one surface of the legwall and at least one surface of the shower module are substantially co-planar; and wherein the upwardly projecting floor area does not overlap with the downwardly projecting seat area.

9. The method of claim 8, wherein the bench includes a backrest extending upwardly from the seat, the backrest defining an upper backrest edge.

10. The method of claim 9, further comprising:

attaching wallboard to the enclosure such that a lower edge of the wallboard is substantially in registry with the upper backrest edge.

11. The method of claim 10, further comprising installing at least one of tile, stone and marble on at least one of the wallboard, the module, and the prefabricated shower bench.

12. A method of installing a tiled shower within an enclosure space bounded by a subfloor and wall studs, the subfloor including a plumbing connection communicating with a waste line, the space defining a boundary, the method including the steps of:

placing a shower module in the enclosure space, said shower module defining an outer peripheral edge, said module including a floor section and at least one sidewall extending upwardly from the floor section, the floor section including an upper surface which terminates at said sidewall and which defines an upwardly projecting floor area, the at least one sidewall ending in an upper sidewall edge;

an area defined by said module being smaller in at least one dimension than an area defined by the boundary, thereby leaving a gap area between said at least one sidewall of the shower module and at least one of said wall studs; and placing a bench in the enclosure space such that the bench covers at least a portion of the gap area;

said bench comprising a seat and a legwall extending downwardly from the seat, the seat defining an upper surface and a lower surface, said lower surface defining a downwardly projecting seat area, the legwall defining a lower legwall edge;

said bench further comprising a bench base adapted to support the bench seat and legwall above the subfloor;

the lower legwall edge resting substantially in registry with the upper sidewall edge;

wherein at least one surface of the legwall and at least one surface of the sidewall are substantially co-planar; and wherein the upwardly projecting floor area does not overlap with the downwardly projecting seat area.

13. The method of claim 12, wherein the bench includes a backrest extending upwardly from the seat, the backrest defining an upper backrest edge.

14. The method of claim 13, further comprising:

attaching wallboard to the enclosure such that a lower edge of the wallboard rests above and is substantially in registry with the upper backrest edge.

15. The method of claim 14, further comprising installing at least one of tile, stone and marble on at least one of the wallboard, the module, and the bench.

16. The method of claim 14, wherein the sidewall and the wallboard do not lie in the same plane.

17. A process for transforming an enclosure space into a shower or bath enclosure, the enclosure space defined by a boundary, comprising the steps of:

determining proposed dimensions of the enclosure space;

specifying a floor module, said floor module comprising a floor and at least one sidewall extending upwardly therefrom, the floor including an upper floor surface which terminates at said sidewall and which defines an upwardly projecting floor area, said sidewall defining an upper sidewall edge, said module defining an outer peripheral edge adapted to be placed within the enclosure space wherein the outer peripheral edge of the floor module defines an area that is smaller than an area defined by the boundary of the enclosure space;

specifying a bench to occupy at least a portion of an open space(s) between the outer peripheral edge of the floor module and the boundary of the enclosure space, the bench comprising a seat and a legwall extending downwardly from the seat, the seat defining an upper surface and a lower surface, said lower surface defining a downwardly projecting seat area, the legwall defining a lower legwall edge; and specifying the placement of the bench within the enclosure such that the lower legwall edge rests substantially in registry with the upper sidewall edge and at least one surface of the legwall and at least one surface of the sidewall are substantially co-planar;

wherein the upwardly projecting floor area does not overlap with the downwardly projecting seat area.

18. The method of claim 17, wherein the bench includes a backrest extending upwardly from the seat, the backrest defining an upper backrest edge.

19. The method of claim 18, further comprising:

specifying wallboard to be attached to the enclosure such that a lower edge of the wallboard rests above and in substantial registry with the upper backrest edge.

20. The method of claim 19, further comprising:

specifying the installation of at least one of tile, stone and marble on at least one of the wallboard, the module, and the shower bench.

21. The method of claim 19, wherein the sidewall and the wallboard do not lie in the same plane.

22. A method for transforming an enclosure space into a shower or bath enclosure space, the enclosure space defined by a boundary, the method comprising the steps of:

determining proposed dimensions of the enclosure space;

selecting a floor module, said floor module comprising a floor and at least one sidewall extending upwardly therefrom, said module defining an outer peripheral edge and being adapted to be placed within the enclosure space wherein the outer peripheral edge of the floor module defines an area that is smaller than an area defined by the boundary of the enclosure space;

the floor including an upper floor surface which terminates at said sidewall and which defines an upwardly projecting floor area;

selecting a bench to occupy at least a portion of an open space(s) between the outer peripheral edge of the floor module and the boundary of the enclosure space;

said bench comprising a seat and a legwall, defining an upper legwall portion and a lower legwall portion, extending downwardly from the seat, wherein said lower legwall is recessed at a lower legwall edge of the upper legwall portion, the lower legwall defining a lower legwall edge;

the seat defining an upper surface and a lower surface, said lower surface defining a downwardly projecting seat area;

said sidewall defining an upper sidewall edge; and installing the bench in such a way that the lower legwall edge of the upper legwall portion rests substantially in registry with the upper sidewall edge of the sidewall;

wherein at least one surface of the legwall and at least one surface of the sidewall are substantially co-planar; and wherein the upwardly projecting floor area does not overlap with the downwardly projecting seat area.

* * * * *